US008136568B2

(12) United States Patent
DeBauche

(10) Patent No.: US 8,136,568 B2
(45) Date of Patent: Mar. 20, 2012

(54) RETRACTABLE ARCHED WINDOW COVERING

(75) Inventor: Alan F. DeBauche, Two Rivers, WI (US)

(73) Assignees: John E. Nortdstrom, Egg Harbor, WI (US); Barbara A. Nordstrom, Egg Harbor, WI (US)

( * ) Notice: Subject to any disclaimer, the term of this patent is extended or adjusted under 35 U.S.C. 154(b) by 170 days.

(21) Appl. No.: 11/558,631

(22) Filed: Nov. 10, 2006

(65) Prior Publication Data

US 2008/0135188 A1 Jun. 12, 2008

(51) Int. Cl.
*E06B 3/94* (2006.01)

(52) U.S. Cl. ..... 160/84.07; 160/134

(58) Field of Classification Search ..... 160/84.02, 160/84.06, 84.07, 134, 168.1 V, 168.1 P
See application file for complete search history.

(56) References Cited

U.S. PATENT DOCUMENTS

| | | | | | |
|---|---|---|---|---|---|
| 1,609,877 | A | * | 12/1926 | Kendall | 160/84.07 |
| 4,699,195 | A | | 10/1987 | Lester | |
| 4,776,380 | A | | 10/1988 | Lester | |
| 4,807,686 | A | | 2/1989 | Schnebly et al. | |
| 4,830,081 | A | | 5/1989 | Morris | |
| 4,934,434 | A | | 6/1990 | Schnebly et al. | |
| 4,934,436 | A | | 6/1990 | Schnebly | |
| 5,010,939 | A | | 4/1991 | King | |
| 5,117,889 | A | | 6/1992 | Coe | |
| 5,139,070 | A | | 8/1992 | Kidd | |
| 5,159,966 | A | | 11/1992 | Fleishman et al. | |
| 5,168,912 | A | * | 12/1992 | Jelic et al. | 160/84.07 |
| 5,183,092 | A | * | 2/1993 | Jelic | 160/84.07 |
| 5,197,526 | A | | 3/1993 | Schon | |
| 5,205,337 | A | | 4/1993 | Bozzo | |
| 5,584,329 | A | | 12/1996 | Thomas | |
| 5,662,153 | A | | 9/1997 | Rosenblatt | |
| 5,765,619 | A | | 6/1998 | Arnold | |
| 5,771,953 | A | | 6/1998 | Benthin | |
| 5,794,680 | A | * | 8/1998 | Xue | 160/84.07 |
| 6,029,733 | A | * | 2/2000 | Xue | 160/84.07 |
| 6,065,523 | A | | 5/2000 | Sanz | |
| 6,145,569 | A | * | 11/2000 | Shaw et al. | 160/84.07 |
| 6,390,172 | B1 | | 5/2002 | Fleishman et al. | |
| 6,820,674 | B2 | * | 11/2004 | Abita et al. | 160/84.07 |
| 6,877,546 | B1 | | 4/2005 | Garcia | |
| 7,048,027 | B1 | * | 5/2006 | Abita | 160/84.07 |
| 7,188,658 | B1 | * | 3/2007 | Nordstrom et al. | 160/84.07 |
| 2008/0093031 | A1 | * | 4/2008 | Alberti | 160/84.07 |
| 2008/0093032 | A1 | * | 4/2008 | Foley et al. | 160/84.07 |

OTHER PUBLICATIONS

The Beautiful Arch Retracta Blind website, www.archedblind.com, printed May 11, 2004, © 2002, 12 pages.

* cited by examiner

*Primary Examiner* — Blair M Johnson
*Assistant Examiner* — Jaime F Cardenas-Garcia
(74) *Attorney, Agent, or Firm* — Alan R. Stewart; Godfrey & Kahn, S.C.

(57) ABSTRACT

A shade for an arched window including an arched track with a movable carriage and a shade member attached to the carriage. A cord actuates the carriage to move along the track and pull the shade member between collapsed and extended positions. A central hub permits the shade member to move laterally as the shade member is moved between the collapsed and extended positions.

23 Claims, 31 Drawing Sheets

RETRACTABLE ARCHED WINDOW COVERING

BACKGROUND

The present invention relates generally to apparatus for mounting blinds within arched windows and drawing the blind across the window to block some or all of the visibility through the arched window. More specifically, the present invention relates to a shade for an arched window including an arched track with a movable carriage and a shade member attached to the carriage.

Many new buildings and homes are designed with arched windows or Palladian style windows and doors. Today, there are several types of coverings available for arched windows, but many tend to be either permanently fixed, that is, not retractable, or they are manually opened and closed. While several retractable style arched window covers are currently commercially available, these designs lack aesthetic appeal, which can severely diminish their value as a decorative item, or they are too cumbersome to use, especially for larger diameter arched windows. Due to design limitations, retractable window coverings are not available for arched windows having relatively large diameters. In addition, the mechanisms may be relatively complex or unattractive.

Consequently, there remains a need for a retractable shade assembly having a cover that can be remotely operated in order to open or close the cover. Preferably, the covering hides the unattractive mechanical elements of the invention that are in plain view to give it an aesthetically pleasing appearance. The covering may be capable of diffusing or blocking sunlight while the covering is in the closed position. Furthermore, the covering preferably accomplishes these goals using a relatively simple mechanical assembly, and with shade members that are readily available with little or no modification.

Conventional approaches exist for using cellular or pleated blinds designed for use with rectangular windows to provide a window covering for arched windows. There are some issues with simply fixing such a blind in an arched window and drawing one corner of the blind around the outer arch of the window. Blinds may tear or distort and improvements to the manner in which a rectangular cellular blind is mounted within an arched window are desirable.

SUMMARY

The invention provides a retractable window covering for covering an arched window. The window covering includes an arched track having an interior groove. A carriage is slidably mounted to the interior groove and movable between the first end and the second end. A shade member has an upper rail and a lower rail with a shade extending therebetween. The outer end of the upper rail is attached to the carriage. The inner end of the lower rail engages a hub allowing the inner end of the lower rail to move toward or away from first end of the arched track.

The hub may include a spring urging the inner end of the shade member toward the first end of the arched track. The carriage may be movable within the interior groove by a continuous bead chain within the interior groove and connected to the carriage, with the continuous bead chain extending between the first end of the arched track to the second end of the arched track. The continuous bead chain may include a loop extending from the first end of the arched track, with the carriage being movable toward the second end of the arched track by pulling on a first side of the loop, and the carriage being movable toward the first end of the arched track by pulling on a second, opposite, side of the loop. The loop of bead chain may extend at least partially through an offset bracket providing support to both sides of the loop. An actuating member may extend within the groove and operate to slide the carriage along the carriage track between the first end and the second end of the arched track. The actuating member may be a continuous length of bead chain. The actuating member may be driven by an electric motor positioned adjacent the arched track. The hub may be mounted directly to the window and provide support for the inner end of the lower rail, with the outer end of the lower rail positioned on a shelf mounted directly to the window, and the first end of the arched track positioned adjacent the shelf. Alternatively, the hub and the lower rail of the shade member may be positioned atop the window sill and the first end of the arched track positioned adjacent the window sill.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts. References to "cellular" blinds may be taken to include generally pleated shade material as well, assuming the properties of the material are similar.

Figure 1:
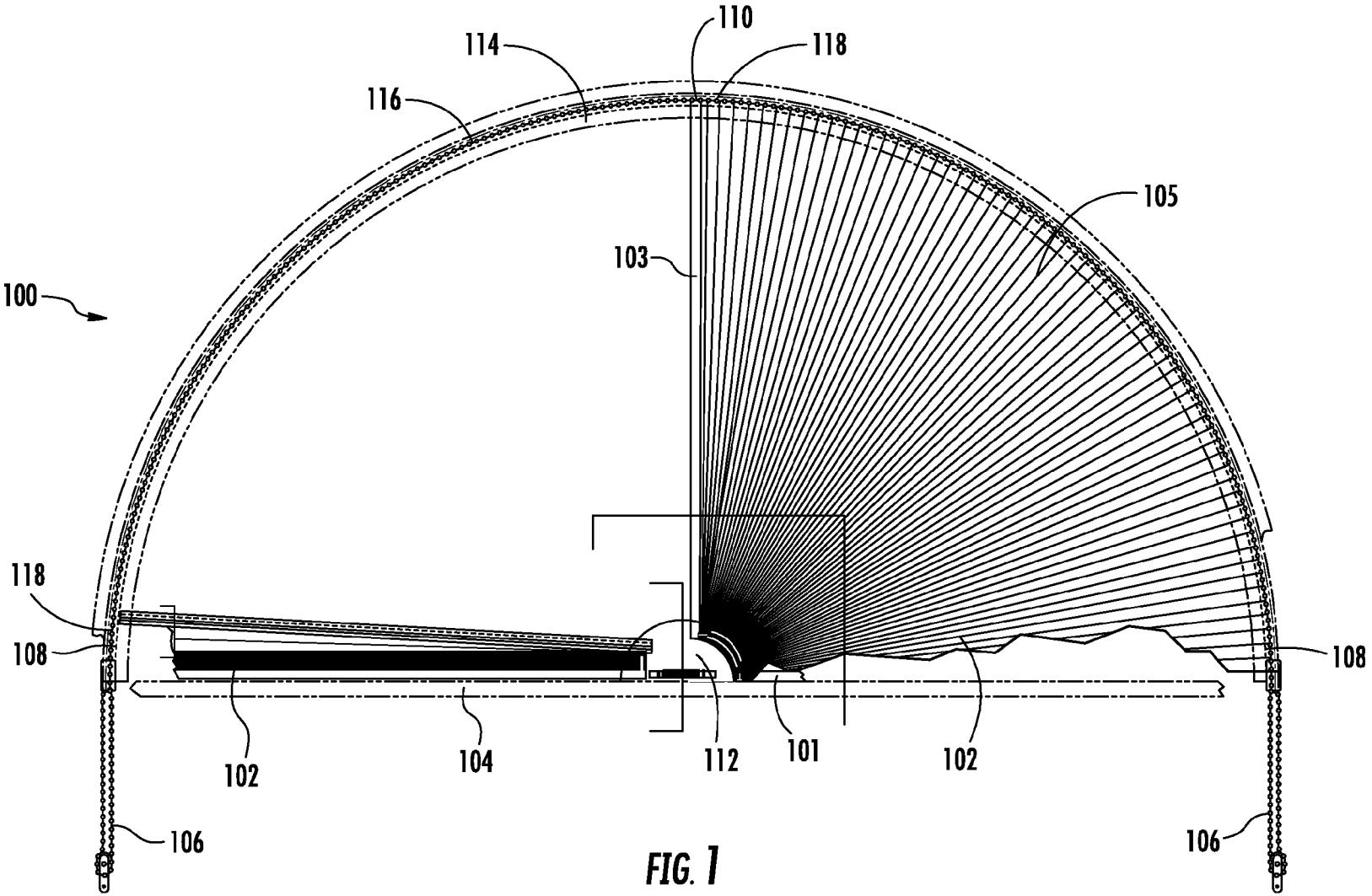
FIG. 1 is a front view of a window shade for an arched window according to the present disclosure, with two independently actuated shade elements.

FIG. 1 illustrates an arched window shade 100 according to the present disclosure which includes two independently actuated shade members or blinds 102. As shown, shade members 102 are cellular blinds of a type commonly used with more conventional rectangular windows and may include a lower rail 101, an upper rail 103 and a shade element 105 extending between the rails. Shade 100 may be mounted to a window sill 104 of the arched window to be shaded or may be mounted to a wall or bulkhead adjacent to the window. Blinds 102 may be moved between the generally fully open position shown on the left side and the generally closed position shown on the right side, or may be positioned at any location between the two positions shown.

Actuating cords or bead chains 106 extend from opposite ends 108 of shade 100. Bead chains 106 may be generally continuous loops extending between one of the ends 108 and about a turning end cap (described below) at a peak 110 or point of maximum extension of blind 102. A portion of the continuous loop may extend from end 108 to permit a user to advance bead chain 106, to either raise or lower the attached blind 102. An inner end of each blind 102 may be positioned within a central hub assembly 112, the operation and function of which will be described below. A generally continuous channel 114 defining an inward facing recess extends between ends 108. A bead chain track 116 may be positioned within the recess of channel 114. Track 116 provides a pathway for bead chain 106 and also for an attached carriage or slide 118 to move between end 108 and peak 110. Slide 118 is attached to an outer end of blind 102 and is moved by actuation of the exposed portion of bead chain 106 along track 116. As slide 118 moves along track 116, blind 102 may be moved to the desired position within shade 100.

Figure 2:
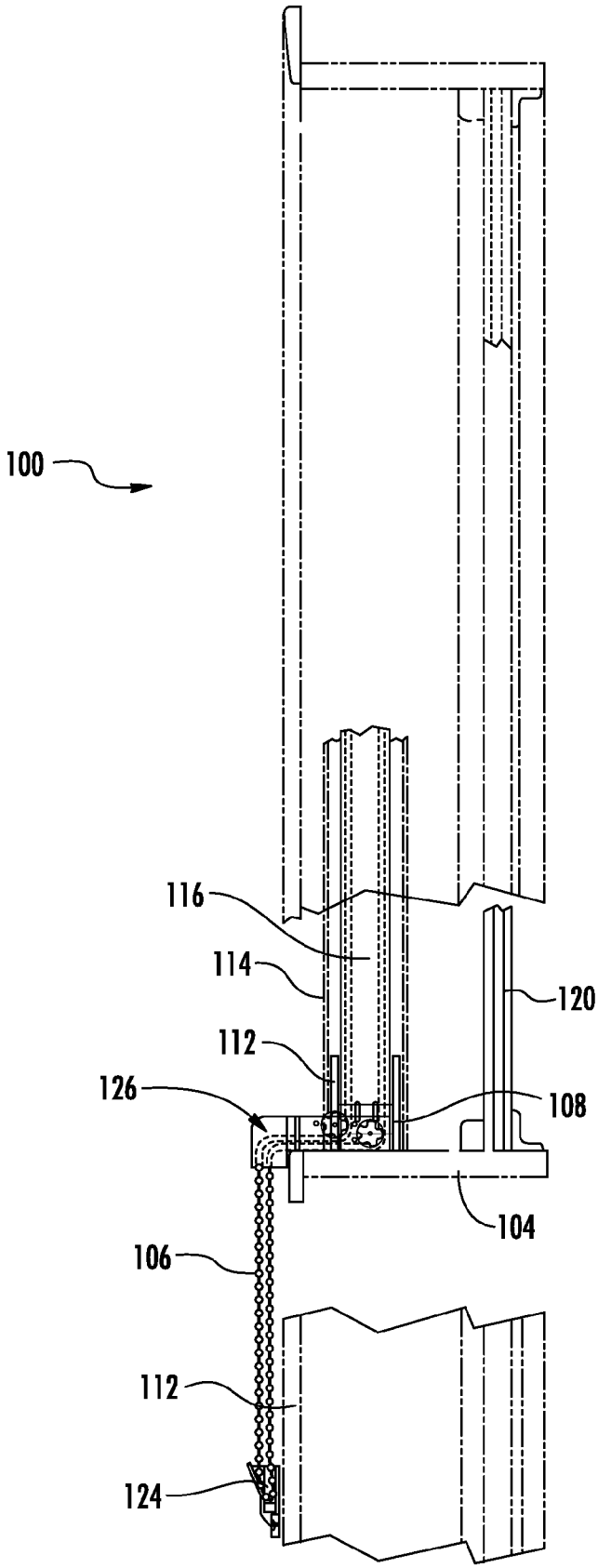
FIG. 2 is a side view of the window shade of FIG. 1.
Figure 3:
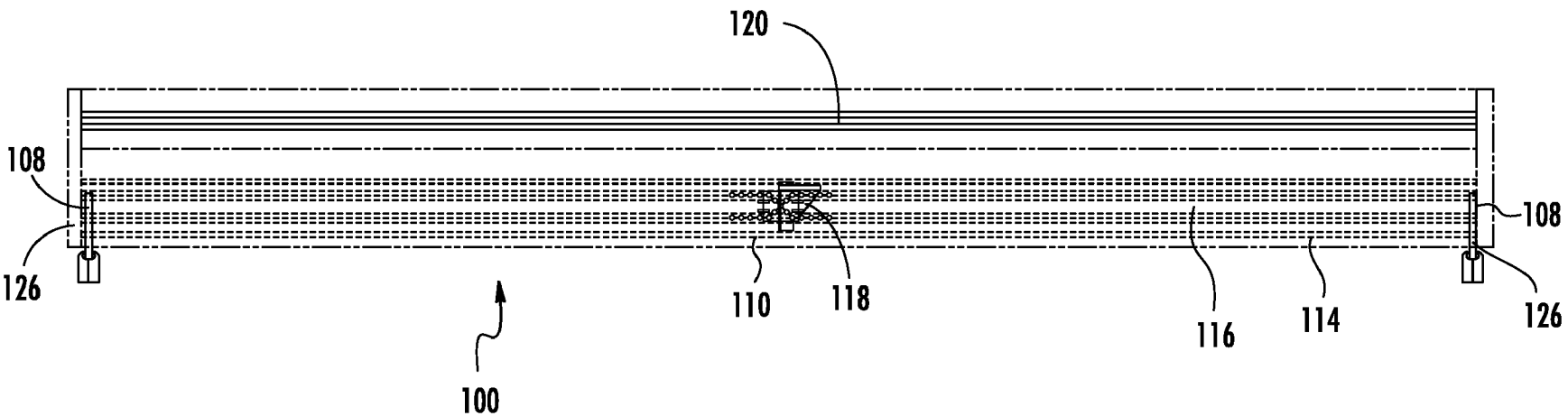
FIG. 3 is a top view of the window shade of FIG. 1

As shown in FIGS. 2 and 3, shade 100 may be mounted adjacent a window 120 with bead chain 106 extending along in interior surface of a wall 122 to or within which window 120 is mounted. A chain keeper 124 may be attached to a lower end of bead chain 106 or the lower portion of bead chain 106 may be left hanging freely or captured in some other device. While chain keeper 124 may be a desirable element of a consumer product, for safety reasons and to meet regulatory agency requirements or consumer safety guidelines, chain keeper 124 is not a required element for the purposes of the present disclosure. As shown in FIG. 2, shade 100 is mounted to a window ledge 104 beneath and adjacent to window 120. However, some windows are mounted without a defined window ledge or may be mounted essentially flush with the interior surface of wall 122. For such configurations of window mounting, shade 100 may be mounted directly to the interior surface of wall 122, to a much narrower sill 104, or directly to window 120. Central hub assembly 112 and channel 114 could be mounted directly to wall 122 so that shade 100 is sufficiently anchored for tension on bead chain 106 to actuate movement of blinds 102 without the need to a significant sill or any sill at all. If hub 112 is mounted directly to wall 122 or to window 120, end shelves or supports may be mounted to the wall or window to support outer ends of lower rails 101 and the chain handling elements of shade 100 that are described in further detail below. Such outer supports to outer ends of blinds 102 and the chain handling elements may be in the form of a continuous support, similar to a window ledge or sill 104 or may be discontinuous, and only extend as much as needed to provide the required support to shade 100.

Alternatively, sill 104 may be significantly wider than shown in FIGS. 2 and 3, and a chain guide assembly 126 at end 108 through which bead chain 106 is directed may be extended further as necessary to ensure that bead chain 106 can extend downward along the interior surface of wall 122.

Figure 4:
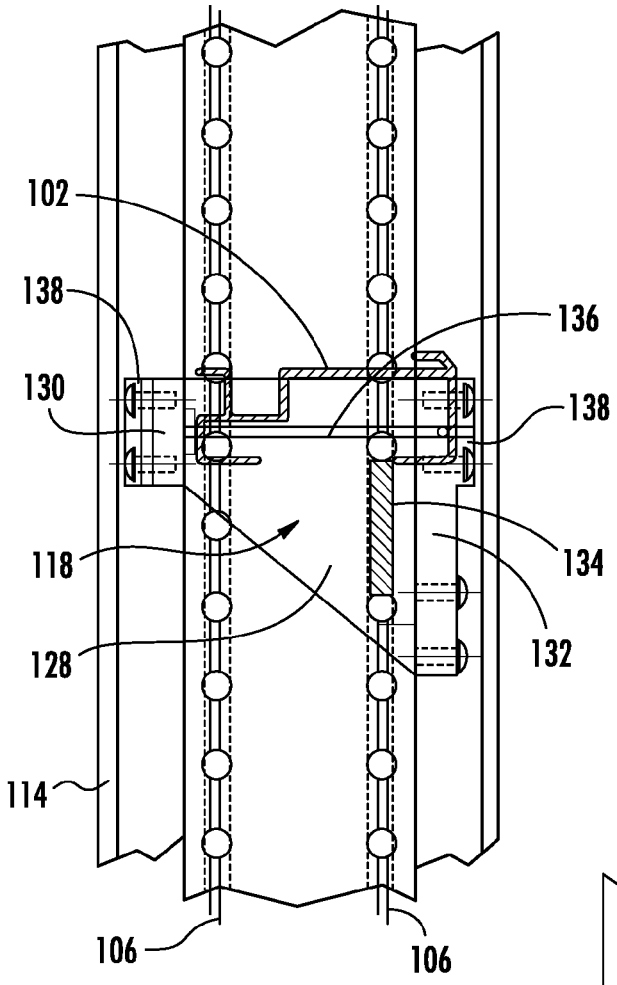
FIG. 4 is a partial cross-sectional view of a slide connected to one of the shade elements of the window shade of FIG. 1, as viewed radially from within the arch.
Figure 5:
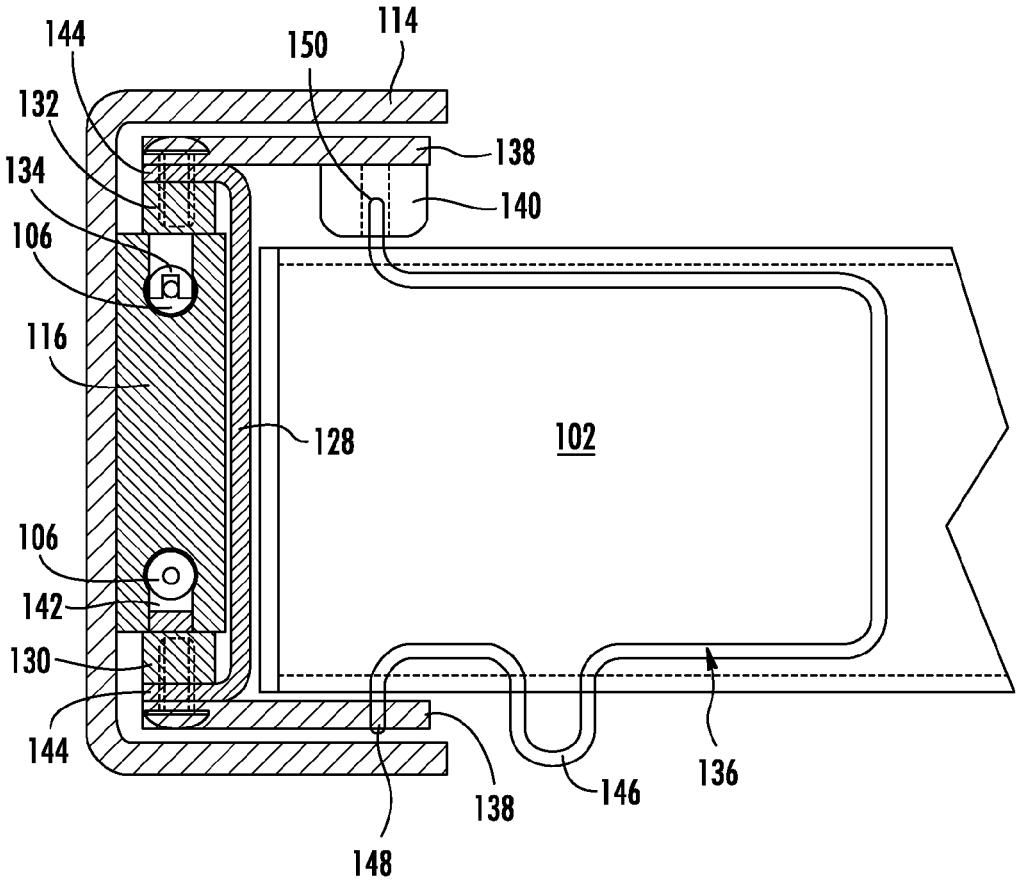
FIG. 5 is a partial cross-sectional view of the slide of FIG. 4, showing a linkage between the shade element and the slider.

FIGS. 4 and 5 show a closer view of slide 118 which is slidably mounted to track 116 and also releasably connected to an outer end of blind 102. Slide 118 may include a base 128, with a slide arm 130 and a forked slide arm 132 which engages bead chain 106. Slide arms 130 and 132 may be removably connected to base 128, such as by screws as shown, and extend within and engage track 116. A connector 134 may be used in conjunction with forked slide arm 132 to aid is engagement of bead chain 106. A pin 136 may be provided within blind 102 to releasably engage an attachment arm 138 on either side of slide 118.

As shown in FIG. 5, forked slide arm 132 extends into track 116 to engage directly bead chain 106, while slide arm 130 extends into track 116 only far enough to engage a slot 142 but not far enough to engage bead chain 106. Base 128 extends across track 116 and provides a mounting flange 144 on either side of track 116 to connect the respective slide arms. Connected to an outer surface of mounting flanges 144 are attachment arms 138 which extend inward to overlap with an outer end of blind 102. Attachment arms 138 may include openings to engage releasable pin 136 to link slide 118 and blind 102. To accommodate different widths and styles of blind 102 within the same slide 118 configuration, one or more spacers 140 may be mounted to attachment arms 138.

It is anticipated that pin 136 may be made of a durable resilient material that will permit a user to depress a finger loop 146 and deflect a first end 148 of pin 136 inward. Once first end 148 has been sufficiently deflected, engagement between pin 136 and attachment arm 138 will be broken and blind 102 will be partially released from slide 118. Second end 150 of pin 136, which is shown received within spacer 140, may then be removed from engagement of slide 118 by manipulating blind 102, fully releasing blind 102 from slide 118. Reengagement of slide 118 may be accomplished by a reversal of this process. It is desirable that a distance or spacing between spacer 140 (if present) of one attachment arm 138 and the other attachment arm 138 should be tailored to match a width of blind 102 closely enough to securely hold blind to slide 118 and avoid accidental release without being so tight as to possibly bind during actuation of slide 118. It is also desirable that sufficient gaps be left on either side of blind 102 within the spacing of attachment arms to allow manipulation of blind 102 to engage and disengage slide 118.

Figure 57:
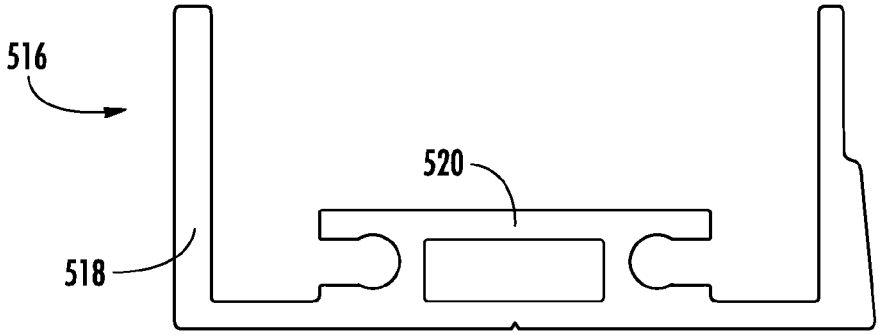
FIG. 57 is an end view of an alternative embodiment of a unitary outer channel and bead guide track according to the present disclosure.

Also as shown in FIG. 5, track 116 and channel 114 are distinct elements for the purpose of showing their distinct functions. However, as noted above, track 116 and channel 114 may be integrally formed, as shown in FIG. 57, below.

Figure 6:
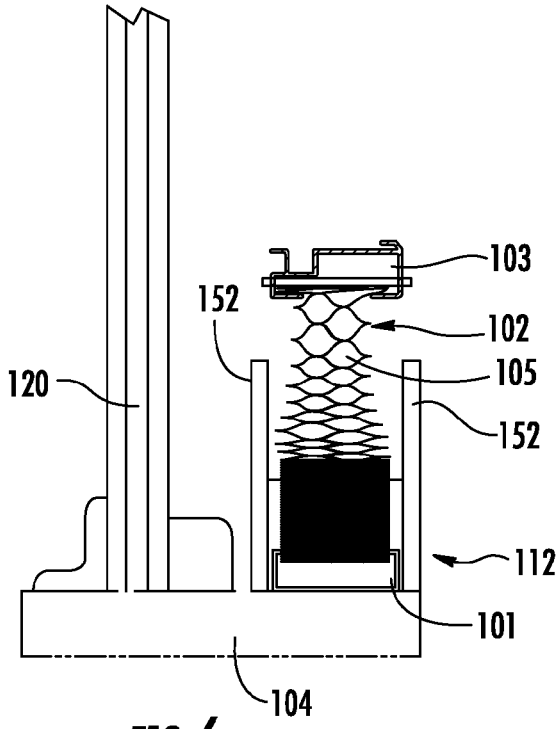
FIG. 6 is a side view of one of the shade elements of FIG. 1, viewed radially from adjacent an arched outer channel toward a central hub.
Figure 7:
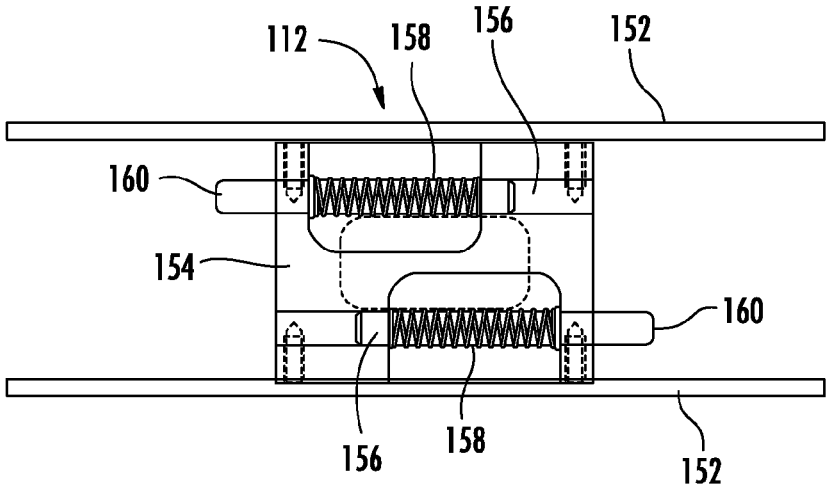
FIG. 7 is a top view of the central hub of FIG. 1.

Referring now to FIGS. 6 and 7, central hub assembly 112 includes a pair of side plates 152 defining a gap within which inner ends of blinds 102 may be received. Positioned between side plates 152 is a hub center 154 within which are mounted one or more push pins 156. Each pin 156 is mounted in conjunction with a spring 158 which is configured to bias a distal end 160 away from hub center 154. Distal end 160 is positioned to engage an inner end of a blind 102 within central hub assembly 112. Each blind 102 defines a certain stack height. This stack height is due to a combination of the height of any upper and/or lower plates that may be used to construct blind 102, and an overall height of the blind material in the compressed or collapsed position. As each blind is moved between the fully collapsed and fully extended positions, as shown in FIG. 1, the stack height causes each blind to move laterally or radially within shade 100. Generally, as blind 102 is moved initially from the collapsed position upward, blind 102 tends to move inward, toward hub 112. As bind 102 approaches its maximum extension, with slide 118 near peak 110, blind 102 will tend to shift back outward, away from hub 112.

If blind 102 is not allowed to move during transit between different positions of extension, wrinkles can result in the material of the blind. Combinations of stack height and durability of cellular blind material may even result in tears in blind 102 if movement of the blind is constrained. However, it has been determined through experimentation and use that merely allowing blind 102 to move freely is not sufficient to address the wrinkling and possible tearing. Early in the movement of slide 118 from adjacent end 108, there is sufficient force applied to blind 102 to displace a freely moving blind 102 inward as needed to avoid wrinkling or tearing. However, as slide 118 approaches peak 110, sufficient force is NOT transferred to a lower portion of blind 102 to move lower portion radially outward again and avoid wrinkling or tearing of blind 102.

Distal ends 160 of pins 156 are positioned to engage an inner end of a lower portion of blind 102 and hold the blind in the correct position to release tension in the blind in the collapsed position. As slide 118 moves from end 108 toward peak 110, and inward pressure is exerted on blind 102, the bias of the spring is overcome, permitting the blind to slide inward and relieve pressure to wrinkle or tear. As slide 118 nears peak 110, and it is preferable for blind 102 to move back outward toward its original position, spring 158 biases pin 156 to move the blind outward. The amount of movement needed to accomplish this reduction of wrinkling or tearing is generally dependent on the width of blind 102, and the stack height of blind 102 in the collapsed position.

Central hub assembly 112 may be adapted as needed to provider greater or lesser amounts of movement both inward and outward of blind 102, or greater or lesser amounts of required pressure in the biasing of distal ends 160 outward, based on the size of blind 102 and material included in the blind. Spacing of side plates 152 may be matched to the width, stack height and amount of predicted movement of blinds 102.

Figure 8:
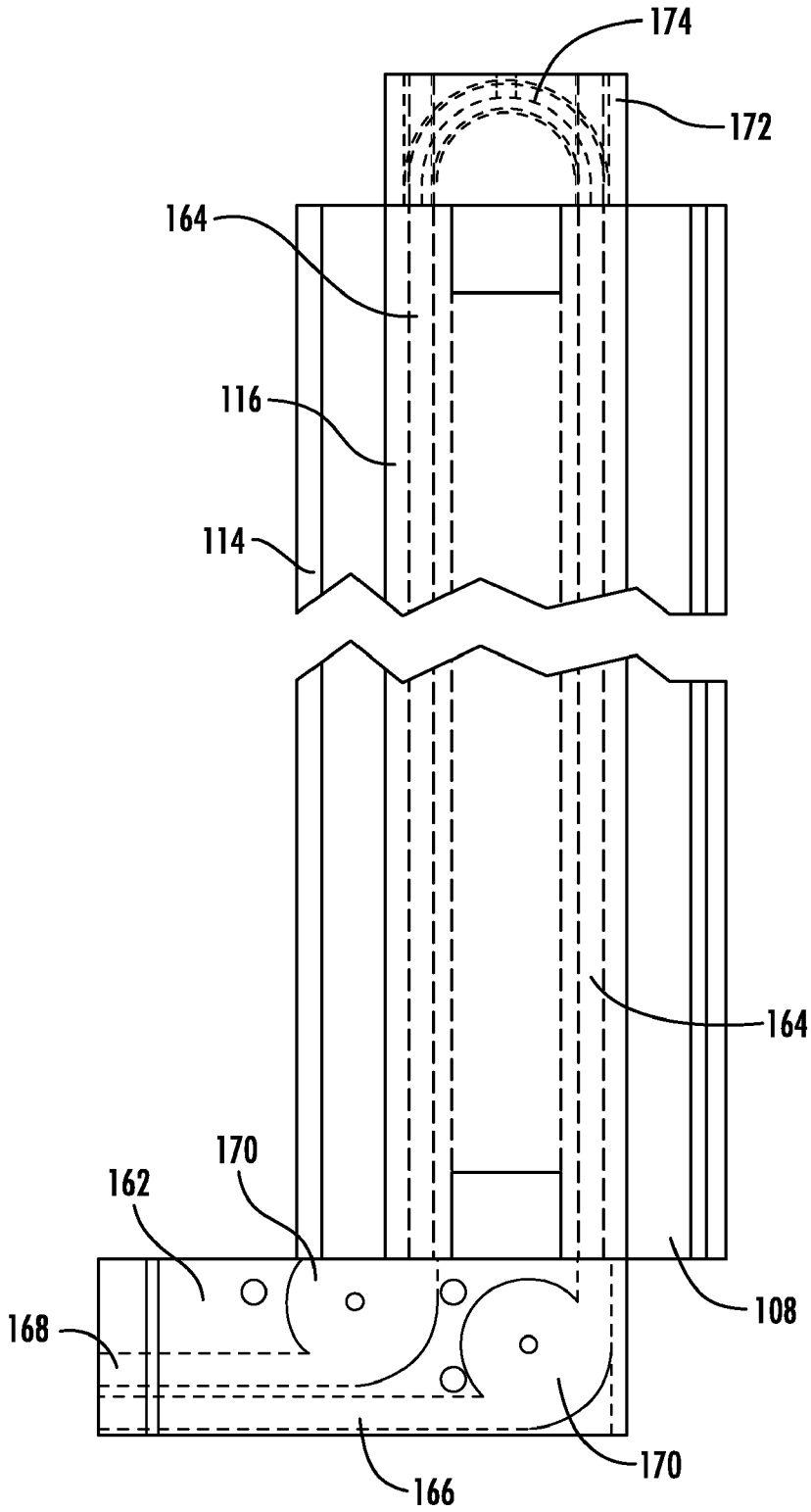
FIG. 8 is a side view of a portion of the outer channel, with a bead guide track and two different chain end guides of the window shade of FIG. 1.

FIG. 8 illustrates several components of shade 100 that define paths of movement of bead chain 106. Bead chain 106, as shown above in FIGS. 1 to 3, runs through track 116 in channel 114. An end fitting, preferably chain guide housing 162, is mounted adjacent end 108 and provides a transition for the bead chain 106 to enter and exit from a pair of parallel chain guide paths 164 of track 116. Within chain guide housing 162 may be a pair of bead chain paths 166 and 168, each including a turning cavity 170 where the bead chain may be transitioned in direction of travel from track 116 to a different desired direction (in this case turn approximately ninety degrees). Depending on the angle and direction of transition and the desired or required radius of this transition, idlers (shown and described below) may be mounted within one or both cavities 170.

Figure 11:
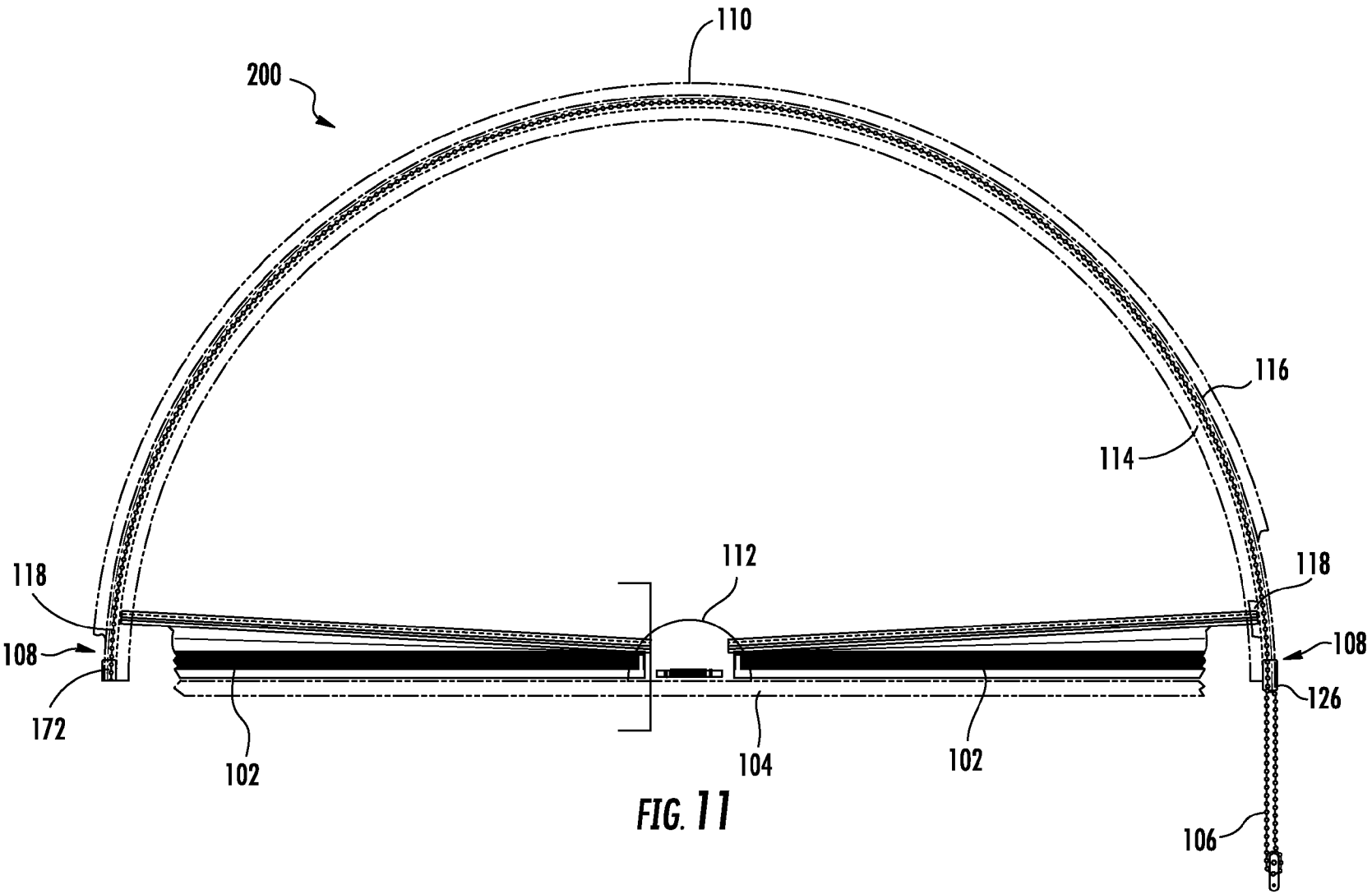
FIG. 11 is a front view of a second alternative embodiment of a window shade for arched windows according to the present disclosure, with two commonly actuated shade elements.

To provide a continuous bead chain path from path 166 of chain guide 162 through track 116 and to path 168 of chain guide 162, another end fitting, preferably end cap 172, may be provided at an opposite end from end 108. As shown in FIG. 1, end cap 172 would be positioned at peak 110. As is shown in FIG. 11 and described below, end cap 172 may be mounted at an opposite end 108 from chain guide 162. Within end cap 172 may be defined a radiused or curved path 174 providing a smooth transition of bead chain 106 from one path 164 of track 116 to the other path 164. Thus, a continuous length of bead chain 106 may extend through chain guide 162, into track 116, about end cap 172, back into track 116 and back through chain guide 162.

Figure 9:
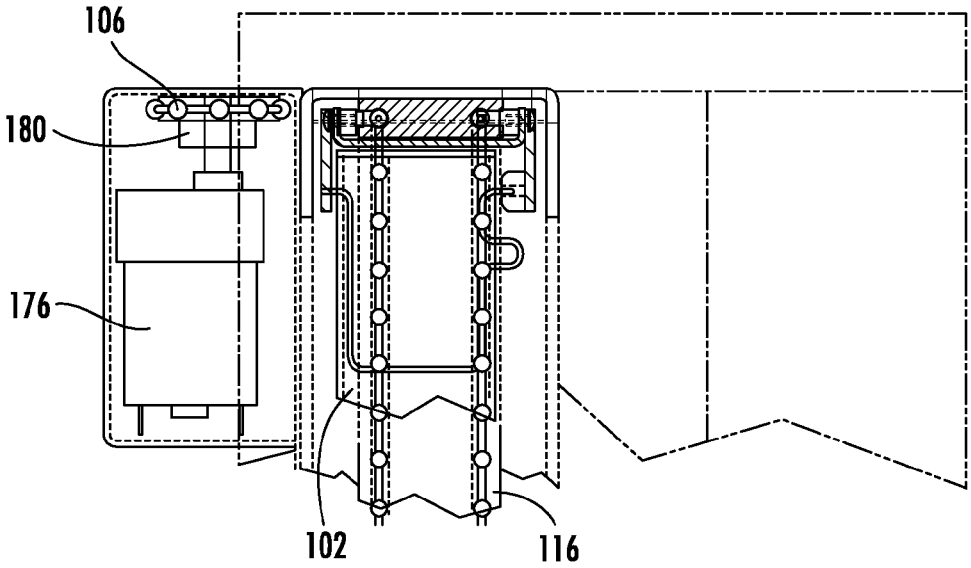
FIG. 9 is a top view of a portion of an alternative embodiment of a window shade for arched windows including a motor to drive movement of the shade elements, according to the present disclosure.
Figure 10:
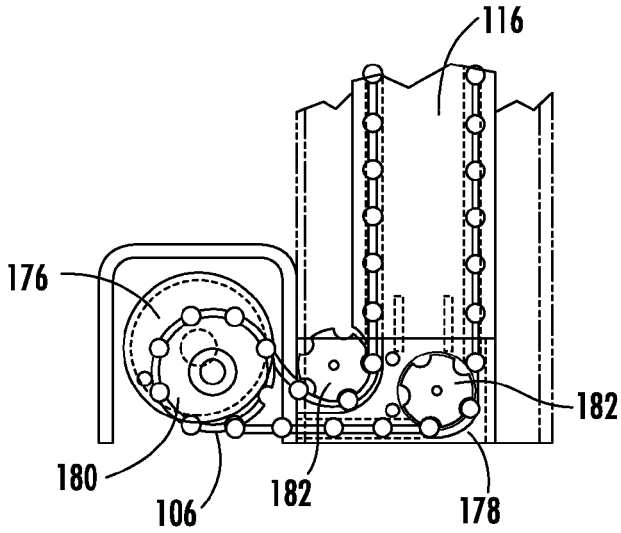
FIG. 10 is a side view of the motor drive of FIG. 9.

While the embodiment shown above includes a length of exposed bead chain 106 to permit manual actuation of blinds 102 by a user, it is also anticipated that a motorized drive may be provided to actuate movement of blind. As shown in FIGS. 9 and 10, a motor 176 may include a gear 180 to engage bead chain 106, either directly or indirectly. A chain guide 178 may be provided to transition bead chain 106 from track 116 to gear 180 about idlers 182 mounted within chain guide 178. A variety of conventional control mechanisms may be used to energize the motor and actuate movement of blinds 102. It is also anticipated that motor 176 could be mounted at other locations along blind 102 where it may be more convenient to locate the motor for aesthetics or operational reasons. For example, it may be desirable to embed the motor in an architectural feature at the peak of the window.

FIG. 11 illustrates a shade 200 according to the present disclosure where both blinds 102 are actuated by a single bead chain 106 extending from a chain guide 126 at one end 108. Both blinds would still meet at peak 110 at a maximum extension but movement of the blinds between collapsed and extend positions would occur simultaneously and the blinds may not be moved independent of each other. Since bead chain 106 runs through track 116 in a pair of parallel paths and about end cap 172, one slide 118 could be connected to the bead chain on a first side of track 116, and a second slide 118 could be connected to the bead chain on the opposite side of track 116. Thus, pulling on one of the exposed sides of bead chain 106 will move the slides 118 simultaneously, but in opposite directions.

Figure 12:
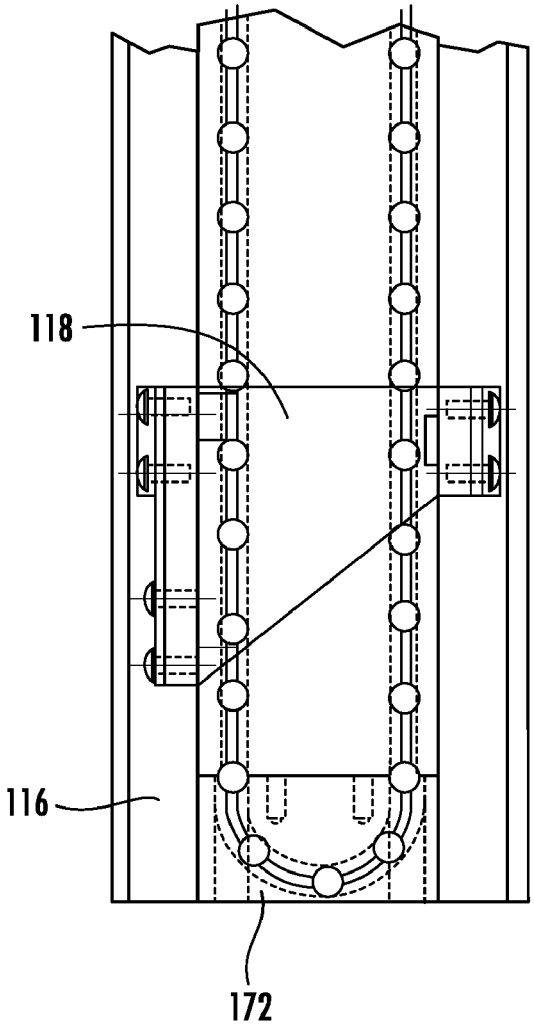
FIG. 12 is a side view of an end of an arched outer channel of the window shade of FIG. 11 opposite an actuator for moving the shade elements.

FIG. 12 shows end cap 172 of shade 200 mounted at the opposite end 108 with one of the slides 118 positioned adjacent the end and engaging one side of bead chain 106.

Figure 13:
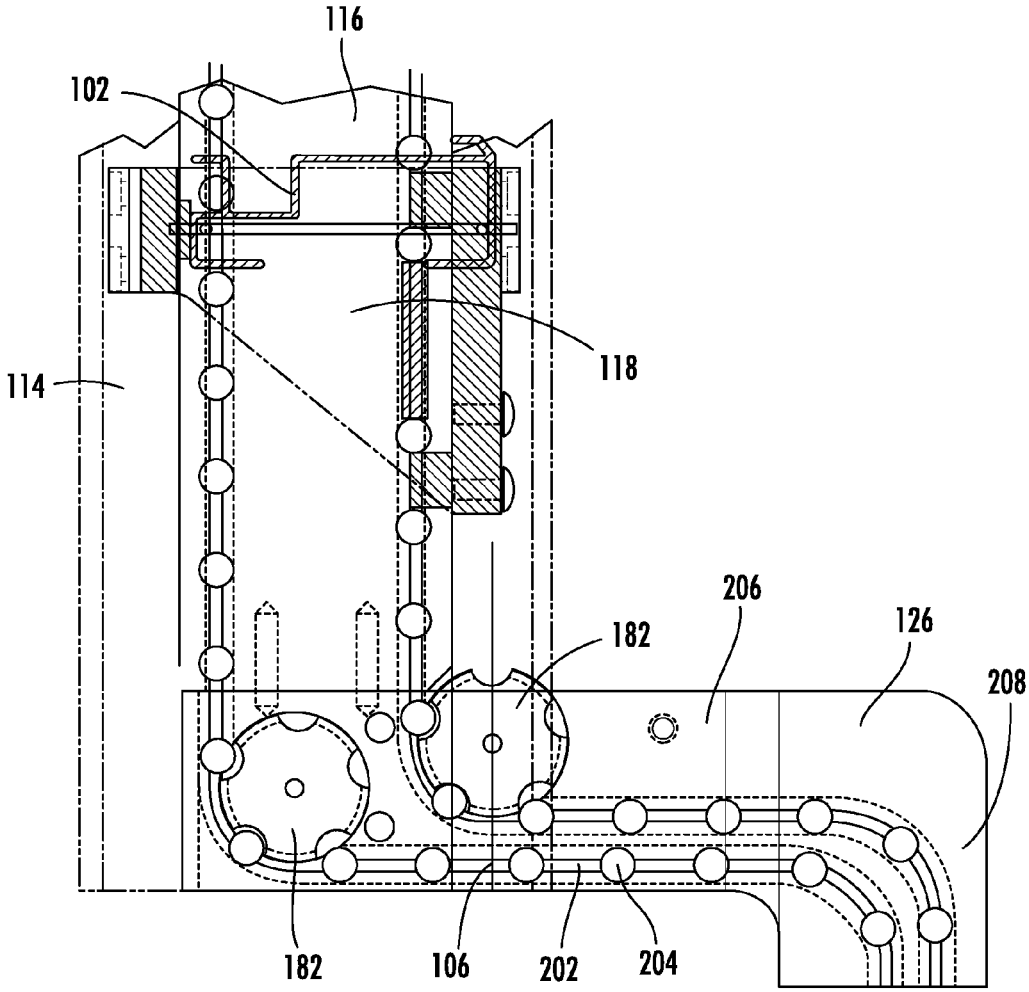
FIG. 13 is a partial cross-sectional side view of an actuating end of the window shade of FIG. 1.

As shown in the FIGS. above, actuating shade 100 and 200 to move blinds 102 is carried out by use of bead chain 106. It is anticipated that other types of cords or chains may be used within the scope of the present disclosure. However, it has been determined through experimentation that use of a bead chain such as chain 106 permits larger blinds to be actuated with less force than the other options known at the present time. Bead chain 106 is comprised of a main cord 202 with a plurality of spaced apart beads 204 having a greater diameter than cord 202, as shown in FIG. 13. The beads may be made of plastic or similar materials that have reduced friction within track 116 as compared to the other options for an actuating cord. For smaller windows, this advantage may not be as desirable, as the forces required to move blinds 102 would not be as great. For larger blinds, used in arched windows having a radius of up to, for example, four or more feet, such reduced friction in the cord may permit greater windows to be shaded. Practical limitations on size may be mainly based on the required tension needed to move blind 102 from collapsed to fully extended, when shades 100 or 200 are manually operated. For motor driven shades, such considerations may be lessened, but reduced friction is generally desirable regardless of the drive used.

Also shown in FIG. 13 is a central extension 206 of chain guide 126. Extension 206 may be lengthened or shortened as need to provide spacing between the vertical to horizontal transition of bead chain 106 about idlers 182 and the horizontal to vertical transition of bead chain 106 within an outer end 208 of chain guide 126. The length of extension 206 needed may be based on a width of window ledge 104, adjacent trim or other architectural features, or other aesthetic or functional limitations. With incorporation of a power drive to actuate shade 100 or 200, the extension 206 and outer end 208 may be eliminated from shade 100 or 200 within the scope of the present disclosure, or may be included to provide a manual backup to the power actuation.

Figure 14:
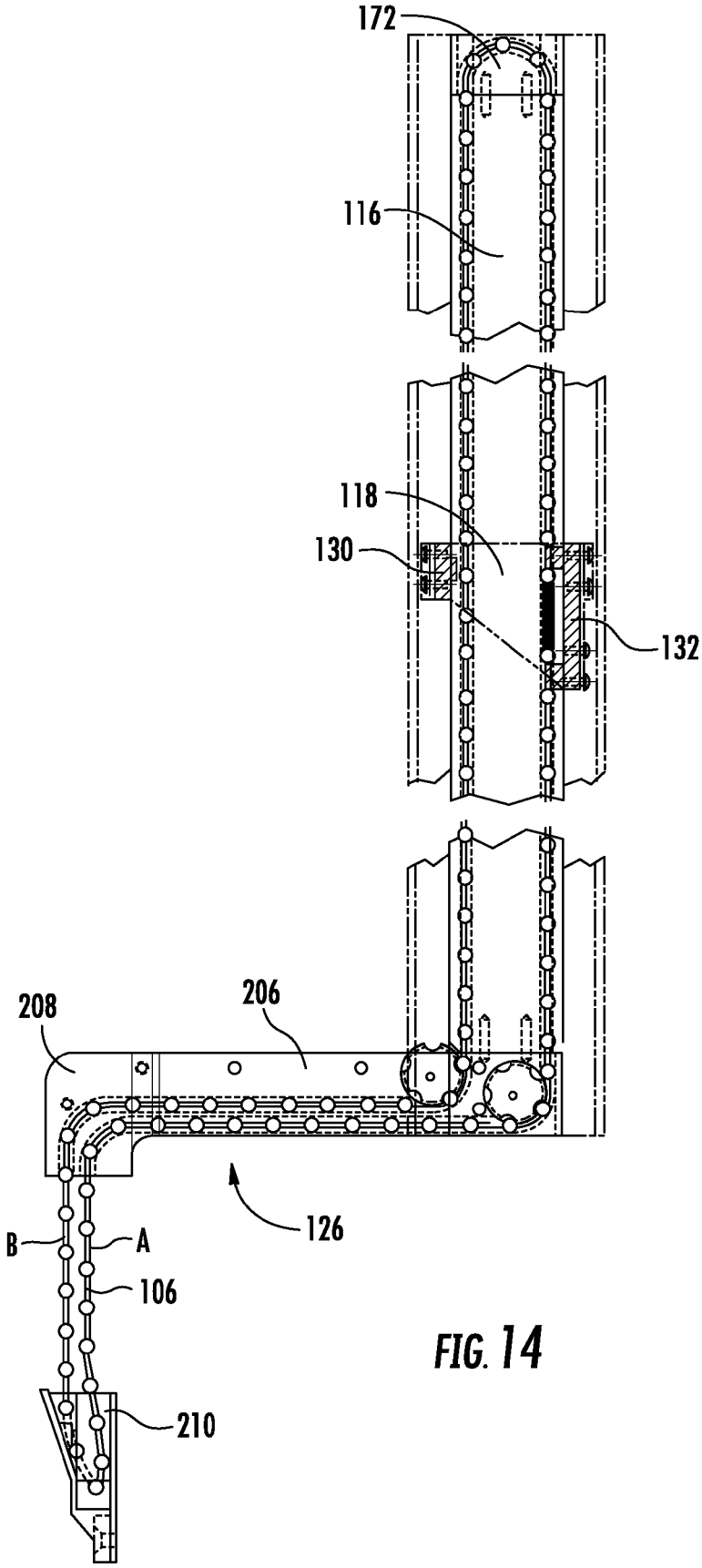
FIG. 14 is a partial cross-sectional view of a an actuating end of a window shade according to the present invention with a slide attached to a shade element in an intermediate position.
Figure 15:
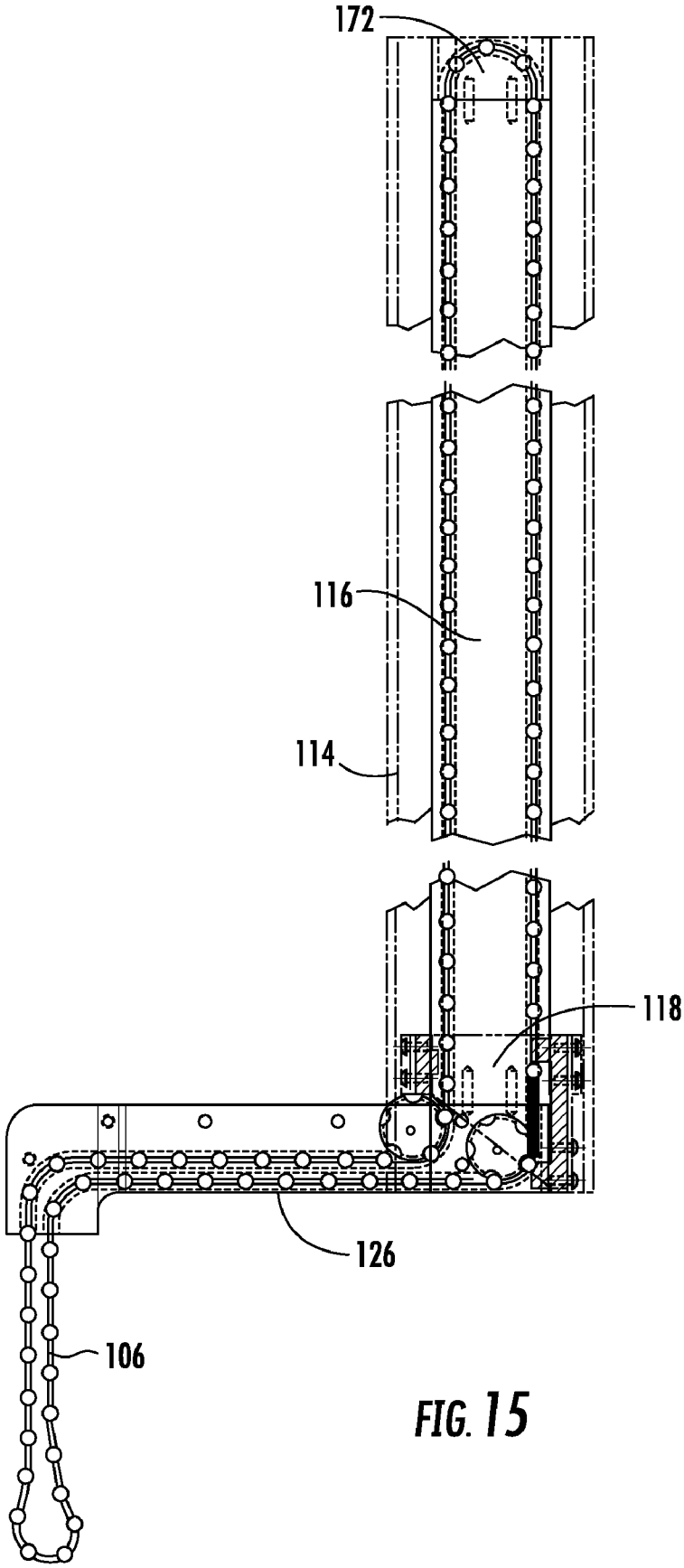
FIG. 15 is a partial cross-sectional side view of the actuating end of FIG. 14, with the slide and attached shade element in a fully lowered position.
Figure 16:
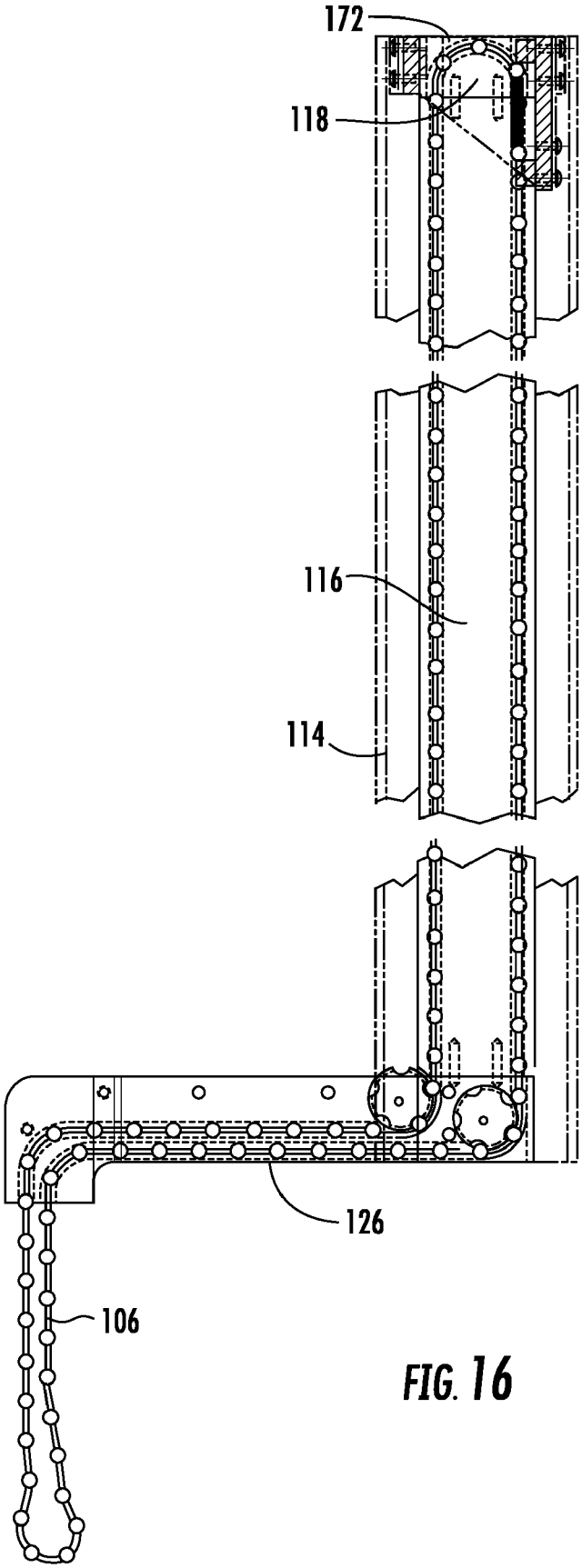
FIG. 16 is a partial cross-sectional side view of the actuating end of FIG. 14, with the slide and attached shade element in a fully extended position.

FIG. 14 illustrates a longer extension 206 and a wall mounted chain keeper 210. Between chain guide 126 and keeper 210 are two lengths of bead chain 106, labeled A and B. As shown, slide 118 is slidably mounted to track 116 by slide arm 130 and forked slide arm 132. Forked slide arm 132 engages bead chain 106 within track 116. Tensioning length A by pulling on bead chain 106 will move slide 118 and an attached blind 102 downward, toward chain guide 126, as shown in FIG. 15. Tensioning length B by pulling on bead chain 106 will move slide 118 and an attached blind 102 toward end cap 172, as shown in FIG. 16.

Figure 17:
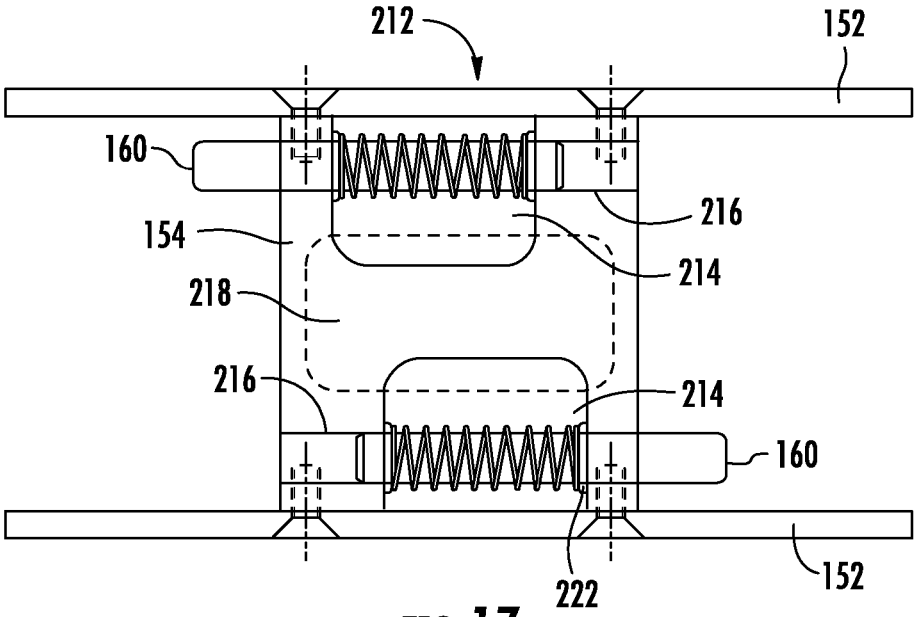
FIG. 17 is a top view of a central hub assembly for use with a window shade according to the present disclosure.
Figure 18:
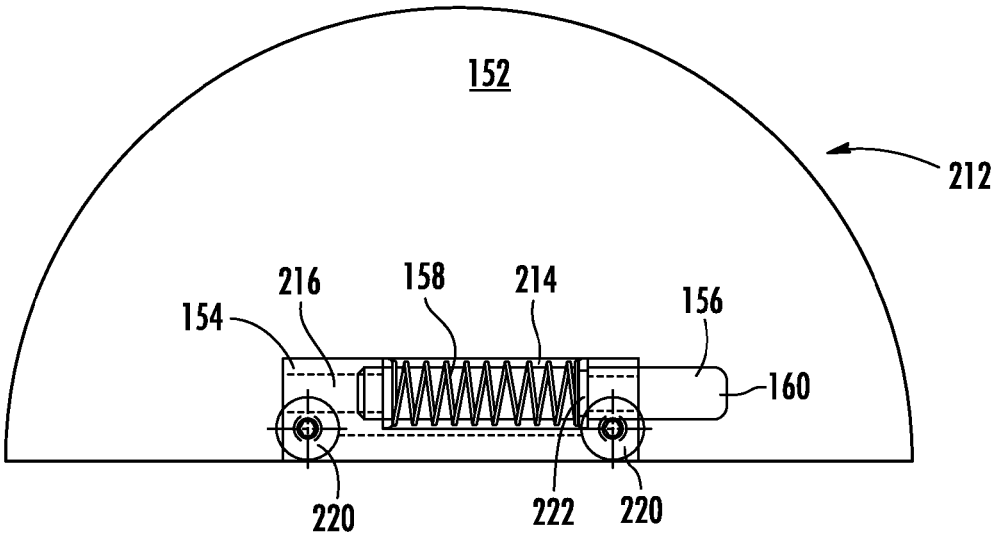
FIG. 18 is a side view of the central hub assembly of FIG. 17.

FIGS. 17 and 18 illustrate a central hub assembly 212, including side plates 152, hub center 154, pins 156, and springs 158 about each pin. Each spring 158 is received within a recess 214 adjacent a pin slot 216. Spring 158 is compressed within recess 214 to exert force against a side of recess 214 opposite distal end 160 of pin 156 and against a thrust washer 222, to resist movement of pin 156 into hub center 154 due to force exerted axially on distal end 160. A pair of screws 220 may be used to removably mount side plates 152 to hub center 154. A recess 218 is shown in a bottom of hub center 154, opposite recesses 214, to cooperate with a matching protrusion on an upper surface of window sill 104 to aid in holding hub assembly 212 in position.

Hub assemblies 112 and 212 are shown with a pair of opposing pins 156, and shades 100 and 200 are shown with a pair of blinds 102. It is anticipated that a shade may be configured with a single blind 102 to work in conjunction with a generally quarter round window, or some lesser arc of a circle. For arched windows from quarter round to half round (i.e., generally greater than ninety degrees in arc to approximately one hundred eighty degrees of arc), it is anticipated that shades having two blinds 102 will be desirable.

Figure 20:
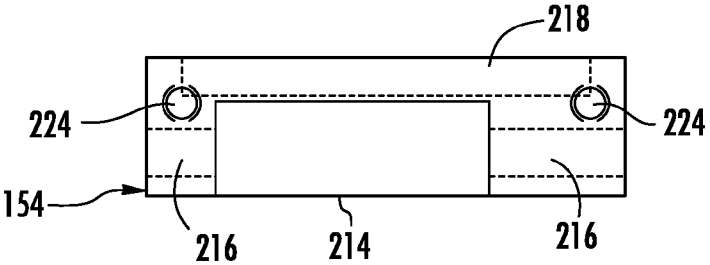
FIG. 20 is an end view of the hub center of FIG. 19.
Figure 21:
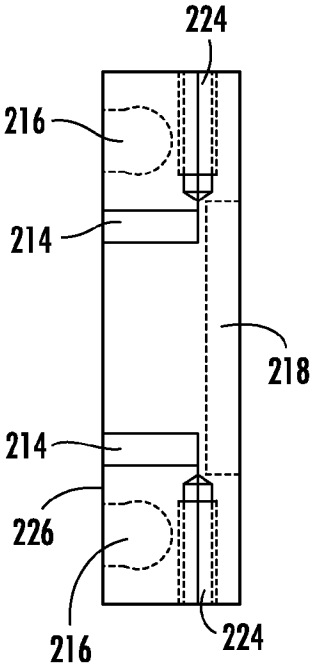
FIG. 21 is a side view of the hub center of FIG. 19.
Figure 19:
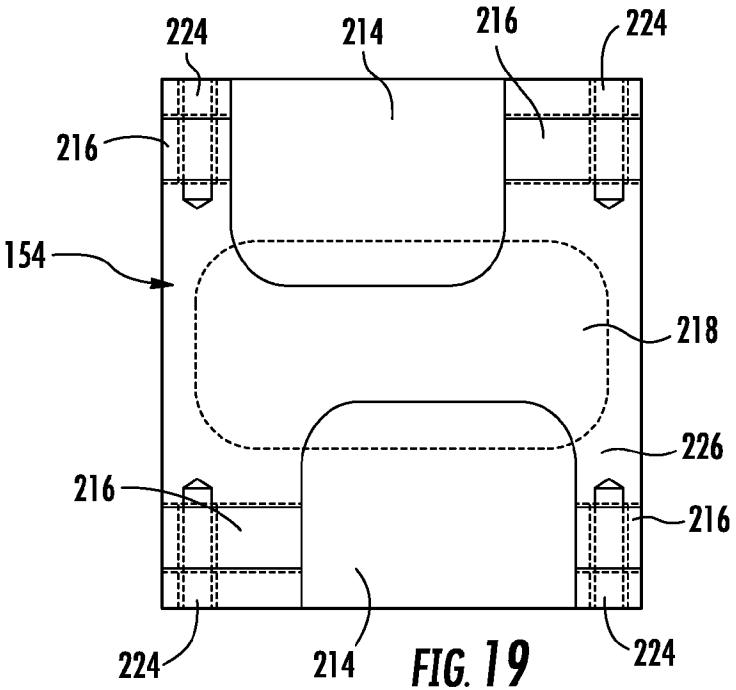
FIG. 19 is a top view of a hub center of the hub assembly of FIG. 17.

FIGS. 19 to 21 illustrate hub center 154 with recesses 214 and 218, and pin slots 216. Fastener holes 224 are provided to receive screws. Pin slots 216 may be configured so that pins 156 may be snapped into place through an upper surface 226 of hub center 154. It is anticipated that hub center 154 may be made of a deformable resilient material so that pins, such as pins 156 described above, can be pressed into slots 216 through upper surface 226 and slot 216 will return to its shown form to hold pins 156. So held, pins 156 have the ability to move axially but not transversely.

Figure 22:
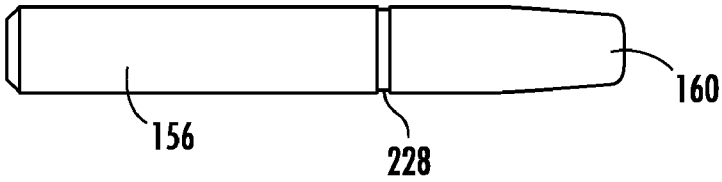
FIG. 22 is a side view of a push pin of the hub assembly of FIG. 17.

FIG. 22 shows pin 156 including a recess 228 for receiving thrust washer 222 or some other feature which will provide a surface against which a spring, such as spring 158 described above, may exert biasing force.

Figure 23:
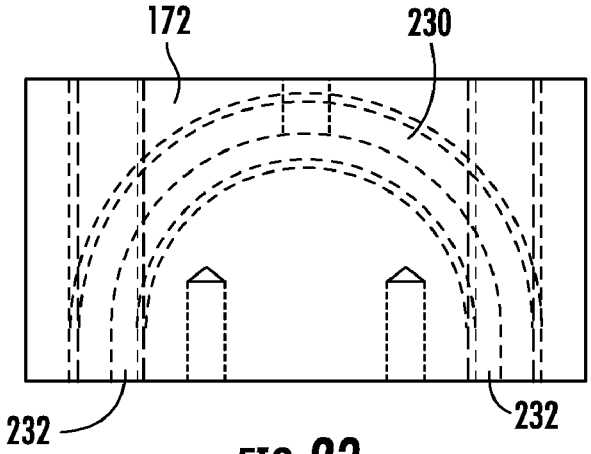
FIG. 23 is a side view of a track end cap, one of the chain end guides of FIG. 8.
Figure 24:
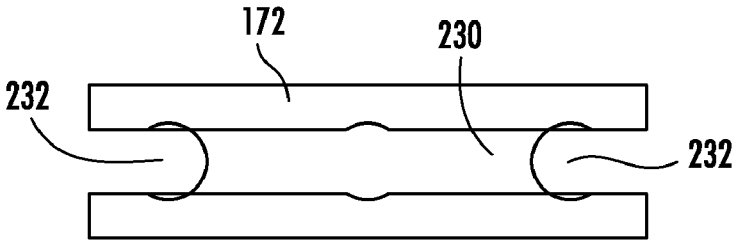
FIG. 24 is a top view of the track end cap of FIG. 23.
Figure 25:
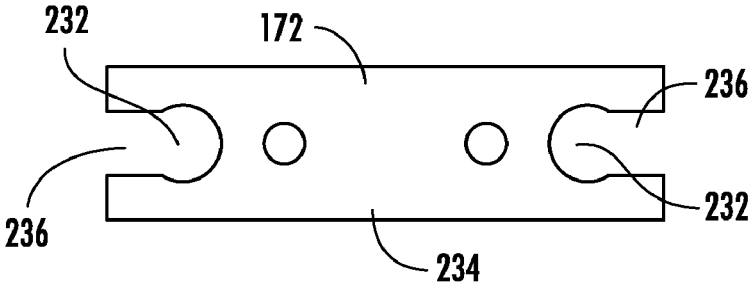
FIG. 25 is a bottom view of the track end cap of FIG. 23.

FIGS. 23 to 25 illustrate end cap 172 including a curved transition groove 230 extending between a pair of opposing bead chain grooves 232. Groove 230 provides a smooth curved transition for bead chain 106 to pass about and make the directions change at either peak 110 (see FIG. 1) or at one of the ends 108 (see FIG. 11). An inner end 234 is provided for mounting end cap 172 to the appropriate position on track 116.

Figure 27:
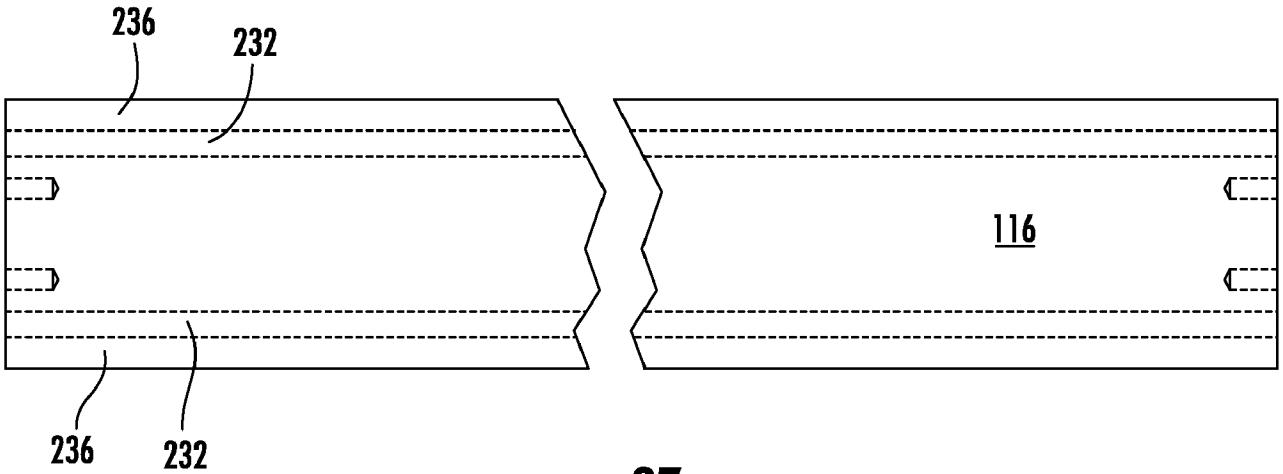
FIG. 27 is a top view of the bead guide track of FIG. 26.
Figure 26:
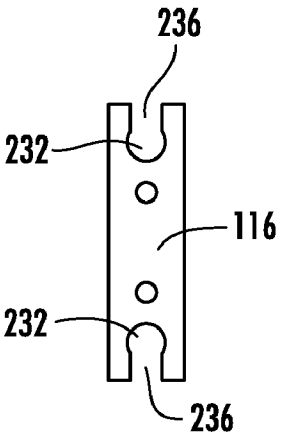
FIG. 26 is an end view of the bead guide track of FIG. 8.

FIGS. 26 and 27 illustrate track 116 with opposing groove 232 which may include a narrower neck portion 236. Narrower portion 236 services to aid in retention of bead chain 106 within groove 232 and also receives a slide arm and forked slide arm of a slide such as slide 118 described above. Groove 232 may be sized to permit smooth passage of beads 204 while portion 236 may be sized smaller than beads 204 to retain bead chain 106 within the groove.

Figure 29:
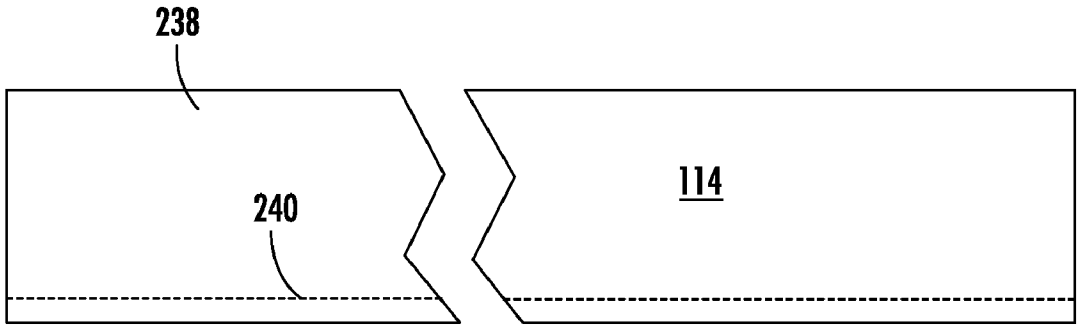
FIG. 29 is a side view of the outer channel of FIG. 28.
Figure 28:
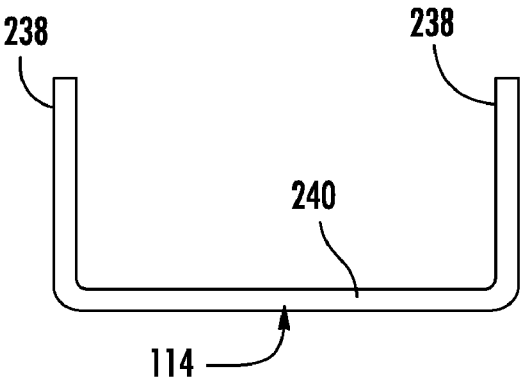
FIG. 28 is an end view of the outer channel of FIG. 8.

FIGS. 28 and 29 illustrate channel 114 with a pair of opposing sidewalls 238 and a transverse bottom 240 extending between the sidewalls. Track 116, described above, may be mounted within channel 114 to bottom 240. Sidewalls 238 provide support to blind 102 and other elements of shade 100 or 200 and also shield track 116 and slide 118 from visibility for a cleaner visual appearance.

Figure 58:
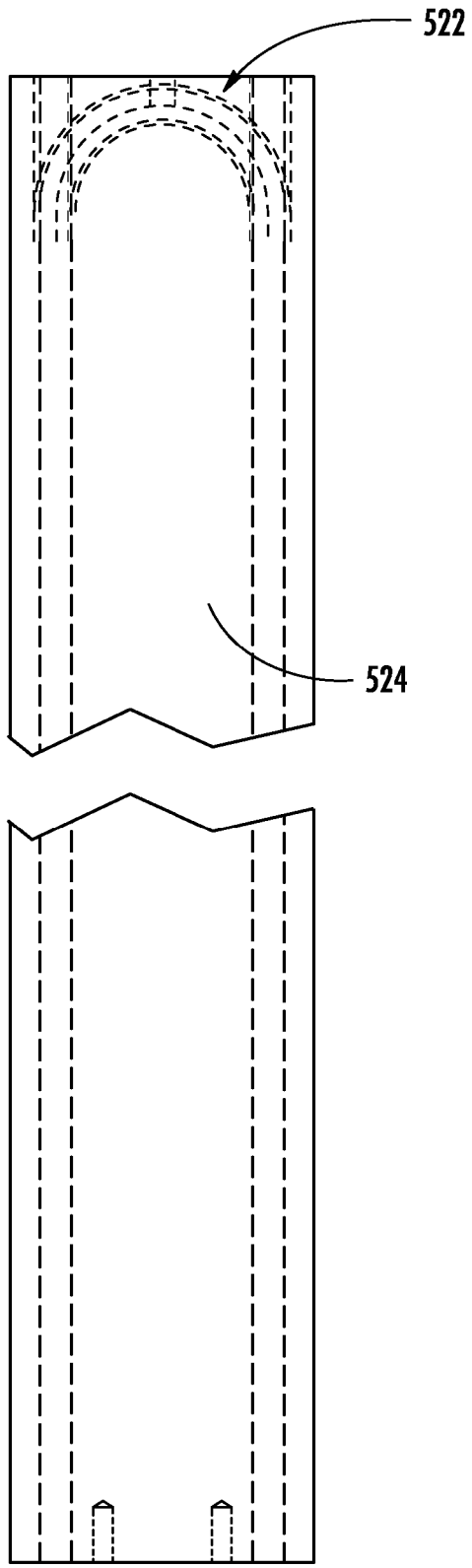
FIG. 58 is a side view of an alternative embodiment of a bead guide track with an integral end cap according to the present disclosure.

Track 116 and channel 114 may be integrally formed with each other in a common mold or extrusion, or they may be separate elements which are mechanically or chemically connected to each other. Such an integrally formed or extruded track 516 is shown in FIG. 57, with a track portion 520 and a channel portion 518. Alternatively, track 116 may have an integrally formed radius at peak 110 and not require an end cap to provide for turning of bead chain 106. Such an integrally formed turning feature 522 is shown in FIG. 58 as part of a track 524.

Figure 32:
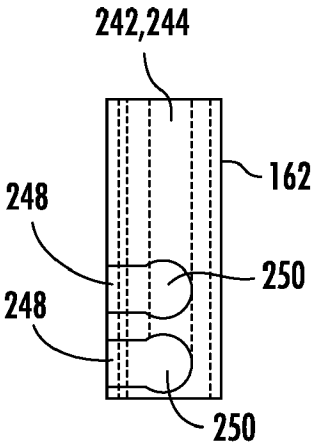
FIG. 32 is an end view of the bead chain guide housing of FIG. 30.
Figure 31:
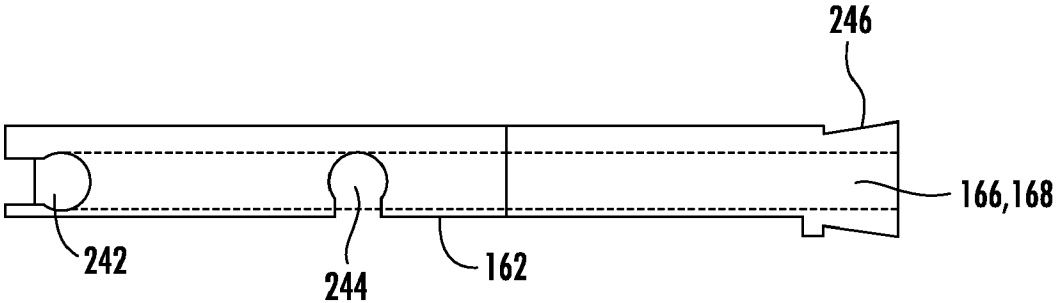
FIG. 31 is a top view of the bead chain guide housing of FIG. 30.
Figure 30:
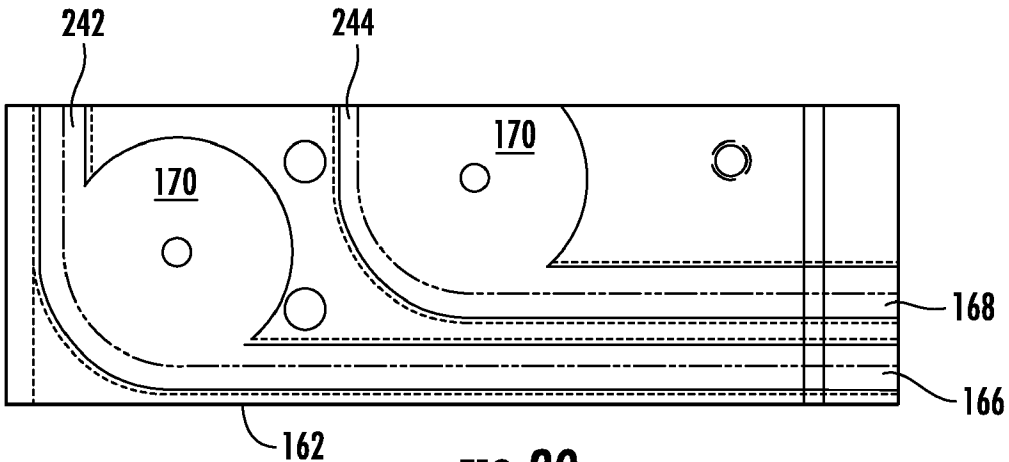
FIG. 30 is a side view of a bead chain guide housing, part of the other of the chain end guides of FIG. 8.

FIGS. 30 to 32 illustrate chain guide housing 162 with the bead chain paths 166 and 168, each including turning cavity 170 where the bead chain may be transitioned in direction of travel from track 116 to a different desired direction. Idlers may be mounted within one or both cavities 170. Bead chain paths 166 and 168 may have similar profiles to grooves 232 (FIGS. 27 and 28) with a narrower portion 248 nearest the outside and a wider portion 250 further in, to permit movement of bead chain 106 while controlling the direction of the movement and reducing the ability of the bead chain to leave the channel. A pair of paths 242 and 244 are provided to direct bead chain 106 into grooves 232 of track 116 from turning cavities 170. A dovetail 246 or other mating or mounting feature may be provided at an end of housing 162 for mounting the transition fitting for transitioning bead chain 106 from paths 166 and 168 and along an inner surface of a wall to which the shaded is mounted.

Figure 59:
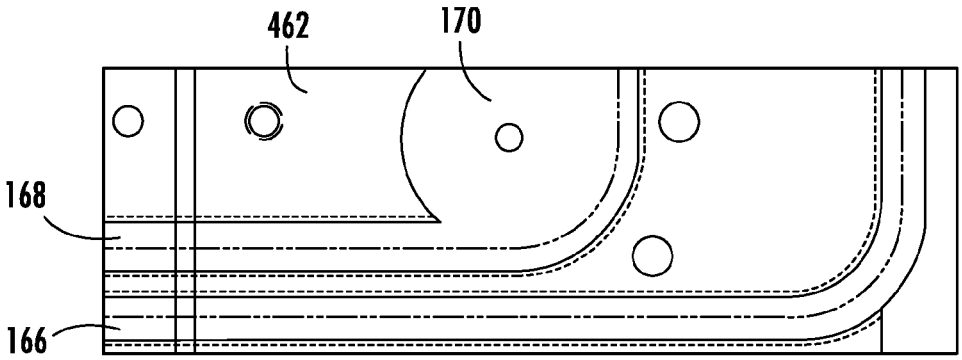
FIG. 59 is a side view of an alternative embodiment of a bead chain guide half with a single cavity for receiving an idler wheel.
Figure 60:
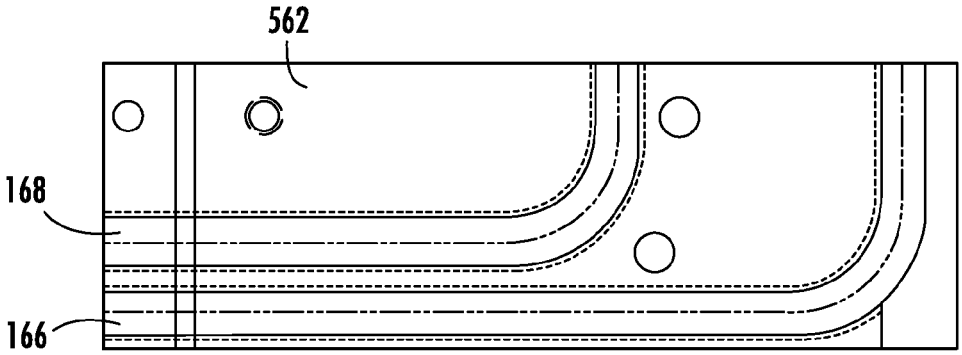
FIG. 60 is a side view of a second alternative embodiment of a bead chain guide half with no cavities for receiving idler wheels.

FIGS. 59 and 60 illustrate alternative embodiments of chain guide housings. FIG. 59 shows a chain guide housing 462 with only a single cavity 170 for an idler in path 168 and does not include provision for an idler in path 166. FIG. 60 shows a chain guide housing 562 with no cavities 170 for idlers. The nature of the actuating cord, such as bead chain 106, and the friction generated by the cord as it moves through chain guide assembly 126 and the rest of blinds 100 or 200, may allow for the elimination of one or both idlers as not being necessary to assist in the changes of direction of the cord. As a further alternative, additional idlers could be added to the blinds if the friction resulting from movement of the cord is too great. For example, an idler could be incorporated into end cap 172 or into an integral turning feature of rail 116.

Figure 33:
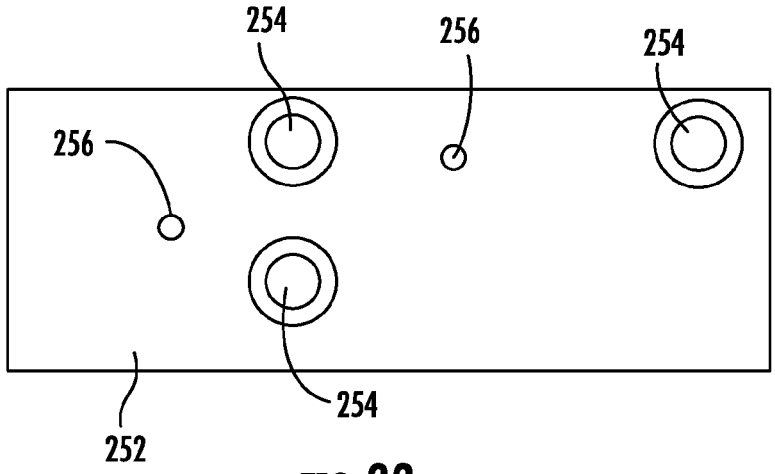
FIG. 33 is a side plate for mounting to the bead chain guide housing of FIG. 30.

FIG. 33 shows a cover plate 252 for mounting to housing 162 and covering the paths and transition cavities of the housing. A plurality of fastener openings 254 may be provided to aid in the mounting of plate 252 to housing 162 and a pair of axle openings 256 are shown to receive pins about which idlers within cavities 170 may rotate.

Figure 34:
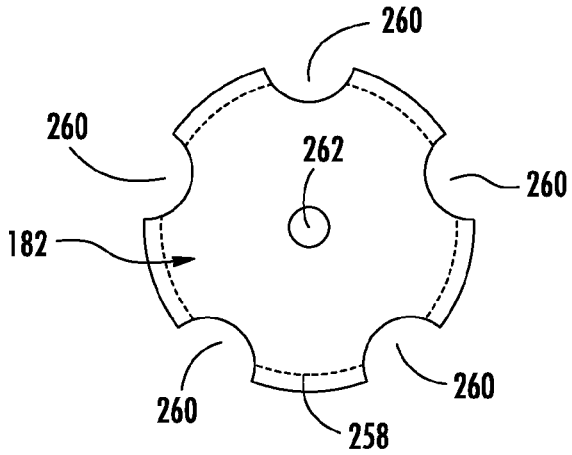
FIG. 34 is a side view of an idler wheel for use with the bead chain guide of FIG. 30.
Figure 35:
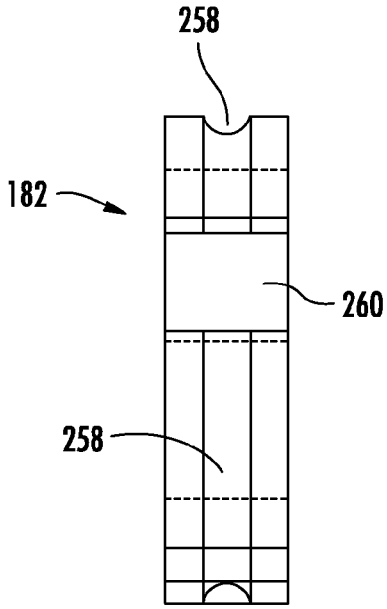
FIG. 35 is an end view of the idler wheel of FIG. 34.
Figure 38:
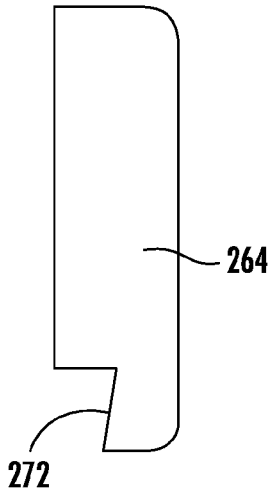
FIG. 38 is a top view of the bead chain turning guide half of FIG. 36.
Figure 36:
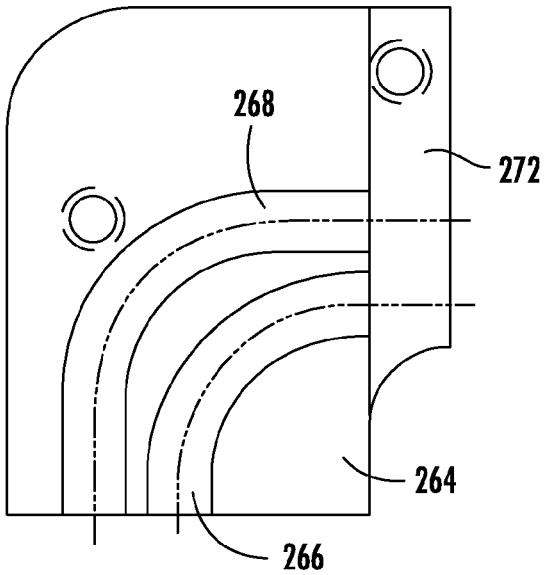
FIG. 36 is a side view of a first bead chain turning guide mating half of the window shade of FIG. 2.
Figure 37:
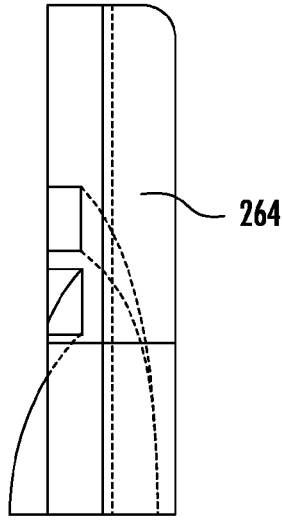
FIG. 37 is a side view of the bead chain turning guide half of FIG. 36.
Figure 39:
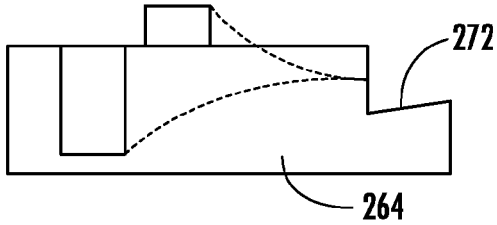
FIG. 39 is a bottom view of the bead chain turning guide half of FIG. 36.
Figure 42:
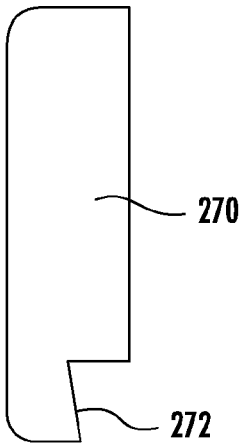
FIG. 42 is a top view of the bead chain turning guide half of FIG. 40.
Figure 41:
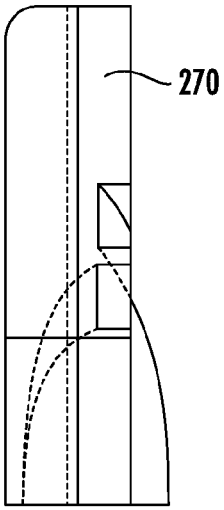
FIG. 41 is a side view of the bead chain turning guide half of FIG. 40.
Figure 40:
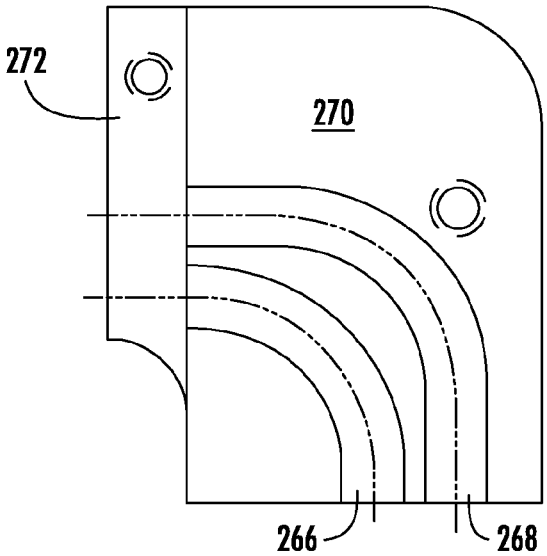
FIG. 40 is a side view of a second bead chain turning guide mating half of the window shade of FIG. 2.
Figure 43:
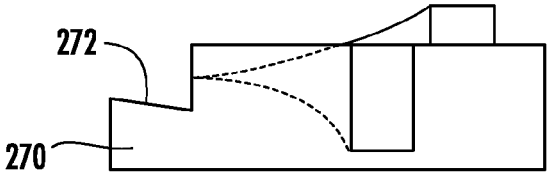
FIG. 43 is a bottom view of the bead chain turning guide half of FIG. 40.

FIGS. 34 and 35 show idler 182 with a circumferential channel 258 for receiving chain 202 and a plurality of spaced apart recesses 260 for receiving beads 204 of bead chain 106. A center opening 262 is provided to receive a pin or other axle about which idler 182 may rotate. Alternatively, idlers could be included in blinds 100 and 200 that do not have a circumferential groove for the chain, or which do not have recesses for beads, which do not have either of these features. Idlers without these features would likely be cheaper and more adaptable to different types and styles of actuating cords.

FIGS. 36 to 39 show a first mating half 264 of an outer end 208 of chain guide 126. FIGS. 40 to 43 show a second mating half 270 of outer end 208. Each of the halves 264 and 270 include portions 266 and 268 which align with and define extensions of paths 166 and 168 of extension 206, when halves 264 and 270 are assembled to form outer end 208. The portions 266 and 268 cooperate to define paths for bead chain 106 to move through and transition smoothly to run along the inner surface of wall 122, as shown in FIG. 2. Each half 264 and 270 includes a portion 272 of a dovetail which mates with dovetail 246 of housing 162 to mount outer end 208. The significant mating surfaces of the dovetails are desirable as actuation of shade 100 or 200 requires downward force to be exerted on bead chain 106 below outer end 208. As bead chain 106 transitions from vertical to horizontal within outer end 208, some of the force is transferred to outer end 208. The dovetail mounting arrangement permits the junction between outer end 208 and guide housing 162 to resist the force that may be repeatedly applied.

Figure 44:
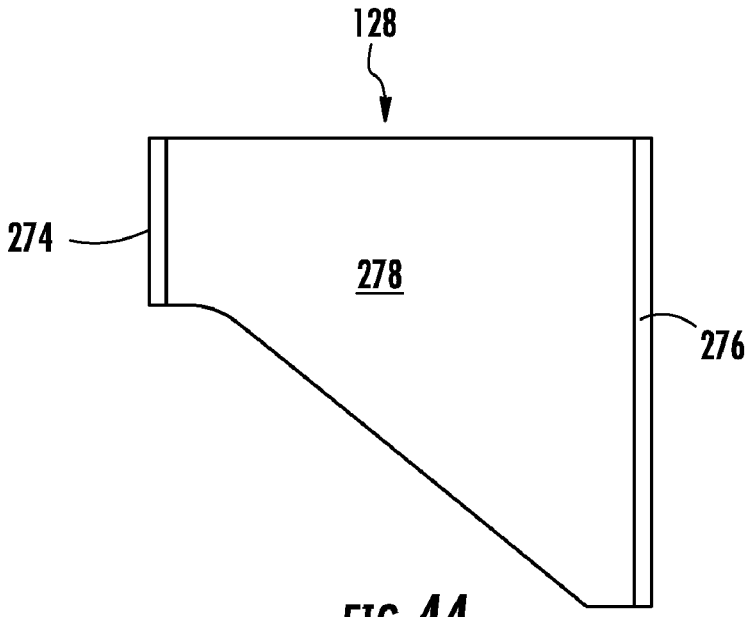
FIG. 44 is a top view of a slide base of the slide of window shade of FIG. 4.
Figure 45:
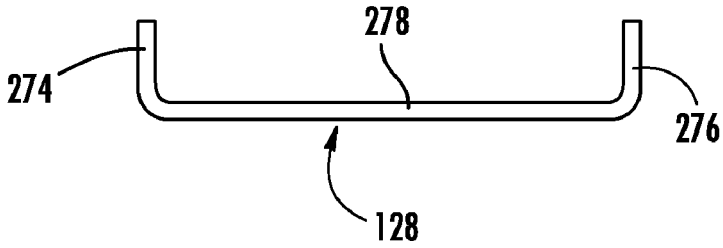
FIG. 45 is an end view of the slide base of FIG. 44.
Figure 46:
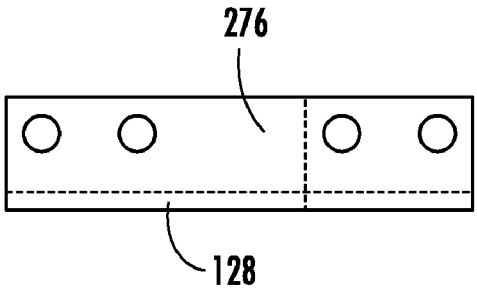
FIG. 46 is a side view of the slide base of FIG. 44.

FIGS. 44 to 46 illustrate slide base 128 which includes a first flange 274 to which slide arm 130 may be mounted, and a second flange 276 to which forked slide arm 132 may be mounted. A central portion 278 extends between the flanges and is sized to span across track 116 to position the slide arms for engaging grooves on either side of track 166. Each flange may include fastener openings to aid in removably mounting the slide arms to base 128.

Figure 47:
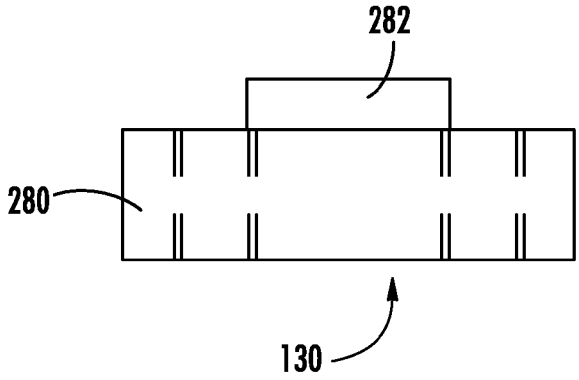
FIG. 47 is a top view of a slide arm of the slide of window shade of FIG. 4.
Figure 48:
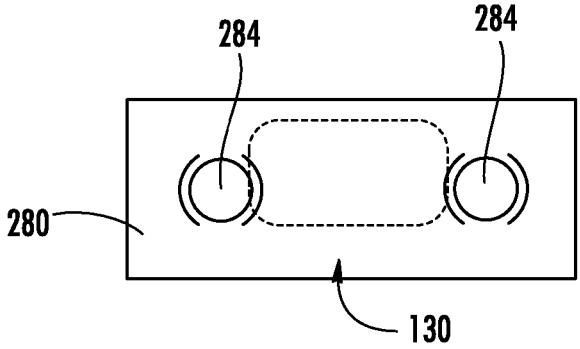
FIG. 48 is a side view of the slide arm of FIG. 47.
Figure 49:
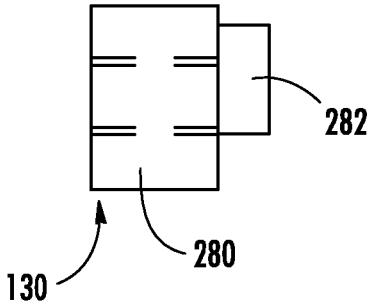
FIG. 49 is an end view of the slide arm of FIG. 47.

FIGS. 47 to 49 illustrate slide arm 130 with a mounting portion 280 and a groove engaging portion 282. Fastener openings 284 may be provided through mounting portion 280 to receive fasteners for mounting slide arm 130 to first flange 274. Groove engaging portion 282 is sized to slidably fit within groove 232 of track 116 and may be slightly rounded as shown to aid in movement through track 116.

Figure 61:
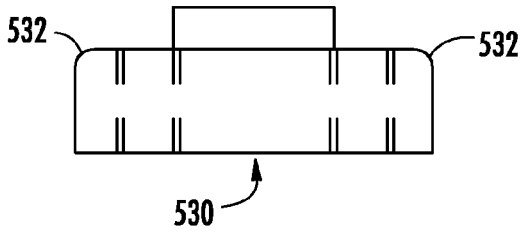
FIG. 61 is an alternative embodiment of a slide arm according to the present disclosure.
Figure 62:
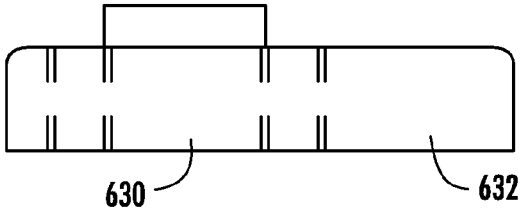
FIG. 62 is a second alternative embodiment of a slide arm according to the present disclosure.
Figure 63:
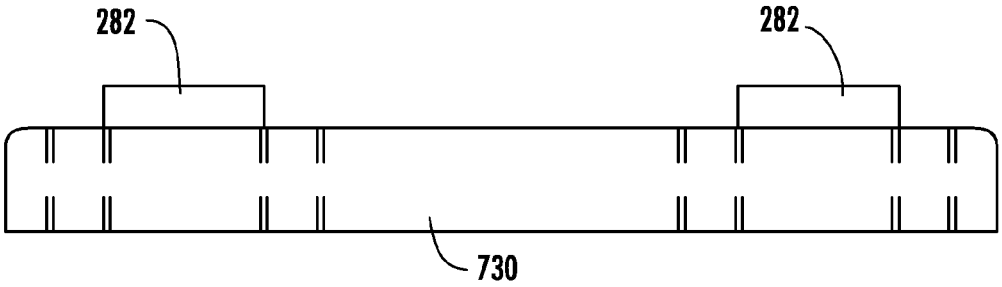
FIG. 63 is a third alternative embodiment of a slide arm according to the present disclosure.

FIG. 61 illustrates an alternative slide arm 530, configured similarly to slide arm 130, with radiused shoulders 532 to aid in movement of shoulder along track 116. FIG. 62 illustrates a further alternative embodiment of slide arm 630, with an extension 632 to help stabilize slider 118 as it moves along blind 100 or 200. FIG. 63 shows another alternative embodiment 730 which includes a pair of groove engaging portions 282 to further add stability and prevent binding or tipping of slider 118.

Figure 52:
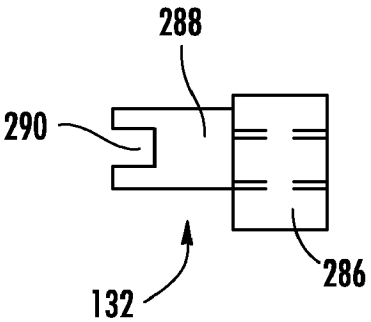
FIG. 52 is an end view of the forked slide arm of FIG. 50.
Figure 50:
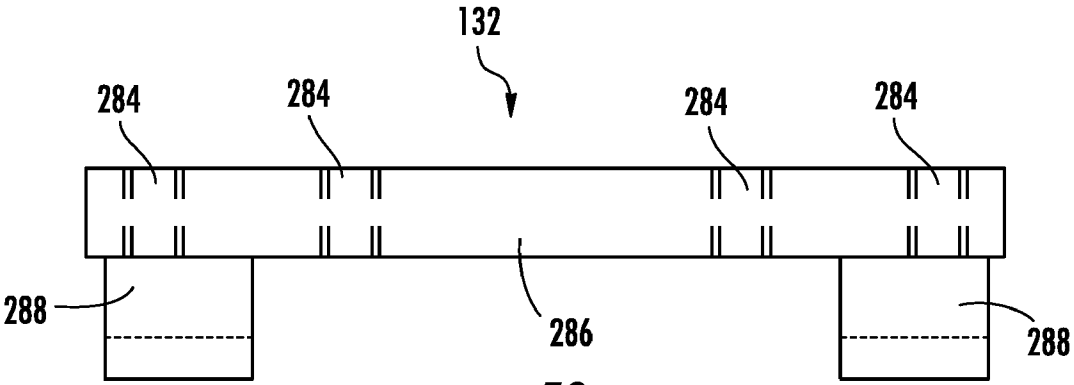
FIG. 50 is a top view of a forked slide arm of the slide of window shade of FIG. 4.
Figure 51:
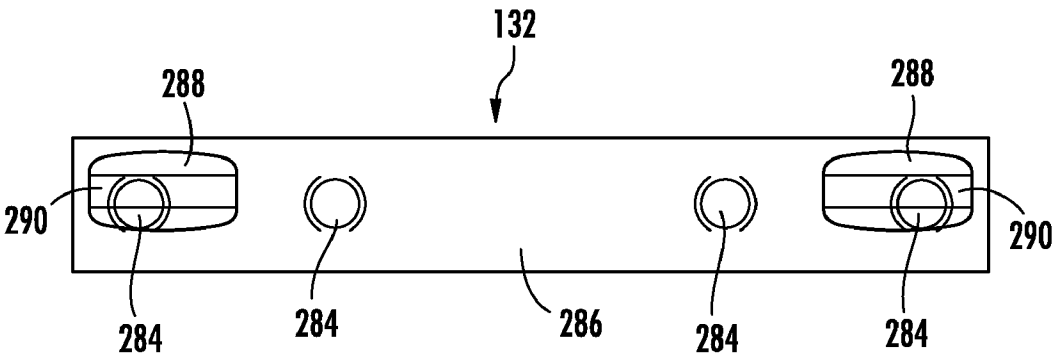
FIG. 51 is a side view of the forked slide arm of FIG. 50.

FIGS. 50 to 52 illustrate forked slide arm 132 including a mounting portion 286 and a pair of groove engaging portions 288. Each groove engaging portion 288 includes a groove on an end opposite mounting portion 286 which extends through groove 232 to engage bead chain 106 within track 116. In addition to engagement of bead chain 106 by grooves 290, connector 134 may be placed about bead chain 106 which extends between the two spaced apart groove engaging portions 288. Spacing of groove engaging portions 288 and width of each groove engaging portion 288 may be selected to match with the size and spacing of beads 204 of bead chain 106. Groove 290 may be sized to fit about cord 202 but not permit passage of bead 204, so that movement of bead chain 106 along track 116 will also move slide 118 along track 116. Forked slide arm 132 may also include a plurality of fastener openings 284 to permit removable mounting of forked slide arm 132 to second flange 276.

Figure 64:
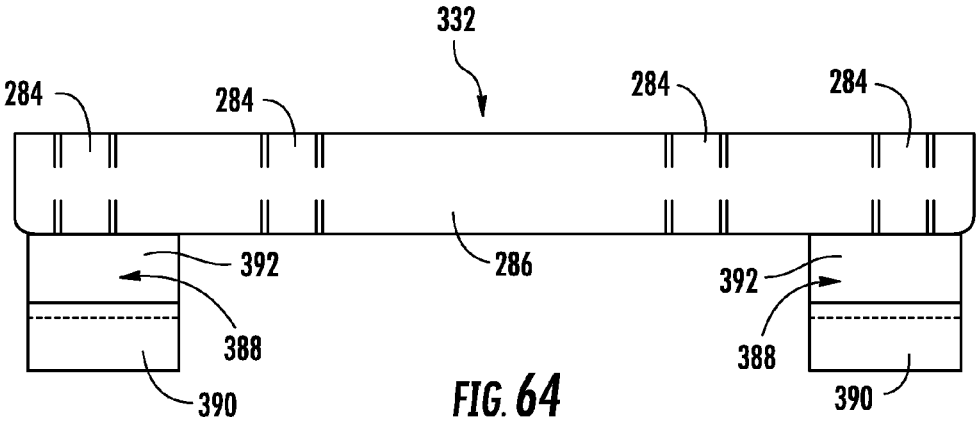
FIG. 64 is a top view of an alternative embodiment of a forked slide arm according the present disclosure.
Figure 65:
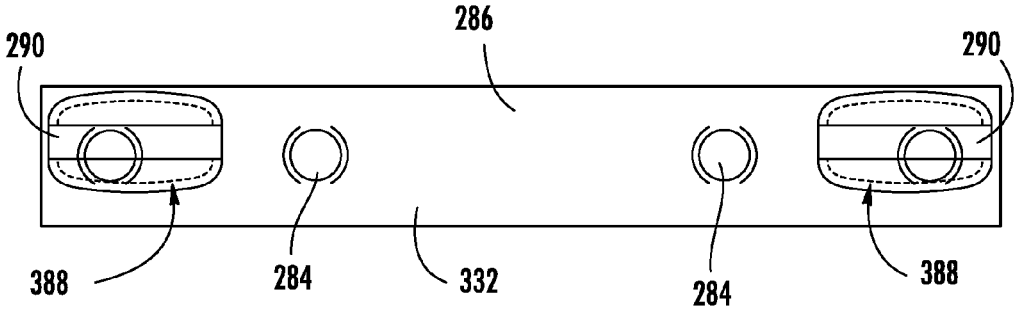
FIG. 65 is a side view of the forked slide arm of FIG. 64.
Figure 66:
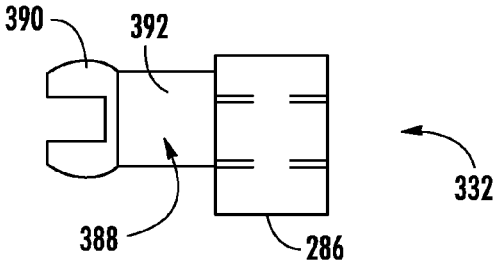
FIG. 66 is an end view of the forked slide arm of FIG. 64.

FIGS. 64 to 66 illustrate an alternative embodiment of a forked slide arm 332 which includes groove engaging portions 388 with an outer ball shaped end 390 supported by an intermediate shaft 392. Ball shaped outer portion 390 may aid in preventing slide 118 from tipping or binding as the slide traverses the track. It is anticipated that the groove engaging portions of both the slide arm and the forked slide arm may be contoured, radiused or otherwise shaped to aid in the smooth movement of the slider along the track. It is not intended to limit the shapes of these elements or the engagement between them in the description herein.

Figure 53:
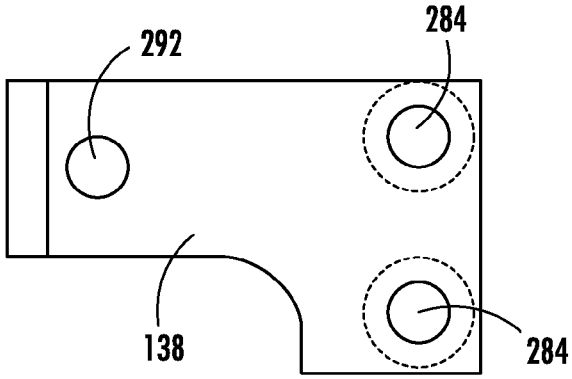
FIG. 53 is side view of an attachment arm of the slide of the window shade of FIG. 4.
Figure 54:
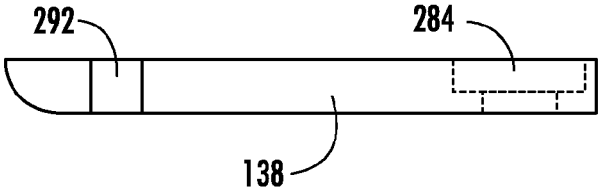
FIG. 54 is a top view of the attachment arm of FIG. 53.
Figure 55:
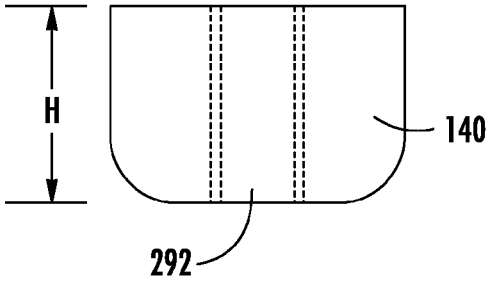
FIG. 55 is a side view of a spacer of the slide of the window shade of FIG. 4.
Figure 56:
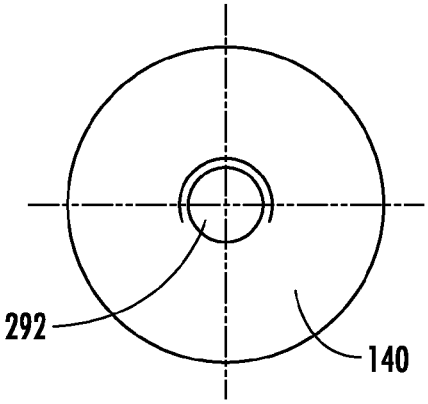
FIG. 56 is a top view of the spacer of FIG. 55.

FIGS. 53 and 54 show attachment arm 138 for connecting slide 118 to blind 102. Attachment arm 138 includes a pair of fastener openings 284 which match up with openings 284 of slide arms 130 and 132 and slide base 128 so that fasteners may be extended through the openings to tie all of the components together, as shown in FIGS. 4 and 5, above. Attachment arm 138 also includes a pin opening 292 to engage ends 148 and 150 of pin 136. Depending on the size of blind 102 as compared to the width of track 116 and thus of slide base 128, spacer 140 may be mounted to one of the attachment arms 138 to aid the engagement of pin 136 to slide 118 in openings 292. Spacer 140 is shown in FIGS. 55 and 56. Spacer 104 defines a height H that may be selected to more closely match the width of blind 102. Spacing of attachment arms 138 is dependent mainly on the width of central portion 278 of slide base 128, and may be too width to permit openings 292 of attachment arms 138 to engage ends 148 and 150. Spacer 140 may be selected with an appropriate height H to extend opening 292 close enough to blind 102 to engage both ends of pin 136. By varying the height of spacer 140, a common slide 118 may be adapted for use with a plurality of different size or width blinds 102.

While the apparatus hereinbefore described is effectively adapted to fulfill the aforesaid objects, it is to be understood that the invention is not intended to be limited to the specific preferred embodiments of retractable arched window shade as set forth above. Rather, it is to be taken as including all reasonable equivalents to the subject matter of the appended claims.

What is claimed is:

1. A retractable window covering for covering an arched window, the window covering comprising:

an arched track having an interior groove, a first end and a second end;

a carriage slidably mounted to the interior groove and movable between the first end and the second end;

a shade member having an upper rail and a lower rail with a shade extending therebetween, the upper and lower rails each having an inner end and an outer end, the outer end of the upper rail attached to the carriage, the shade member configured to move between a first fully retracted position and a second fully extended position; and a hub engaging the inner end of the lower rail, said hub having the capability of allowing the inner end of the lower rail to move toward or away from first end of the arched track, the hub configured to push the lower rail outward toward the first end of the arched track when the shade member is in the fully retracted position, allow movement of the lower rail away from the first end as the shade member is moved from the fully retracted position toward the fully extended position, and move the lower rail toward the first end as the shade member nears the fully extended position.

2. The retractable window covering of claim 1, wherein the hub includes a spring urging the inner end of the shade member toward the first end of the arched track.

3. The retractable window covering of claim 1, further comprising a continuous bead chain within the interior groove and connected to the carriage, for moving the carriage within the interior groove, the continuous bead chain extending between the first end of the arched track and the second end of the arched track.

4. The retractable window covering of claim 3, wherein the continuous bead chain includes a loop extending from the first end of the arched track and the carriage is movable toward the second end of the arched track by pulling on a first side of the loop and the carriage is movable toward the first end of the arched track by pulling on a second opposite side of the loop.

5. The retractable window covering of claim 4, wherein the loop of bead chain extends at least partially through an offset bracket providing support to both sides of the loop.

6. The retractable window covering of claim 1, further comprising an actuating member extending within the groove and operable to slide the carriage along the carriage track between the first end and the second end of the arched track.

7. The retractable window covering of claim 6, wherein the actuating member is a continuous length of bead chain.

8. The retractable window covering of claim 1, wherein an actuating member extends between the first end and the second end of the arched track and is operable to move the carriage along the interior groove between the first end and the second end of the arched track, the actuating member driven by an electric motor positioned adjacent the arched track.

9. The retractable window covering of claim 1, wherein the hub is mounted directly to the window and provides support for the inner end of the lower rail, the outer end of the lower rail being positioned on a shelf mounted directly to the window, and the first end of the arched track positioned adjacent the shelf.

10. The retractable window covering of claim 1, wherein the arched window includes a window sill, and wherein the hub and the lower rail of the shade member are positioned on the window sill, and the first end of the arched track is positioned adjacent the window sill.

11. The retractable window covering of claim 1, comprising a second shade member and a second carriage.

12. The retractable window covering of claim 11, wherein each of the shade members is movable independently of the other.

13. The retractable window covering of claim 11, wherein the shade members are commonly actuated.

14. The retractable window covering of claim 11, wherein the second shade member has an upper rail and a lower rail with a shade extending therebetween, the upper and lower rails each having an inner end and an outer end, the outer end of the upper rail attached to the second carriage, and wherein each of the inner ends of the pair of shade members engages the hub and the hub permits inward movement of the shade members as the carriage attached to each shade member is moved along the track.

15. The retractable window covering of claim 14, wherein the hub includes a pin engaging the inner end of each shade member, wherein the pin is capable of being displaced inwardly by the shade member, and each pin having a spring biasing the pin outwardly.

16. A window shade for an arched window, the shade comprising:

a cellular blind;

a curved track;

a carriage slidably mounted to the track and releasably connected to the blind;

a cord positioned within a groove of the track and connected to the carriage, a loop of the cord extending from an end of the track;

a hub engaging an inner end of the blind and permitting movement of the blind between the hub and the end of the track, the hub biasing the blind toward the end of the track;

wherein pulling on one side of the loop of the cord moves the cord within the groove and moves the attached carriage along the track, and movement of the carriage along the track moves the blind between collapsed and extended positions; and, further wherein, the hub is configured to push a lower rail of the blind outward toward an end of the curved track when the blind is in the fully retracted position, allow movement of the lower rail away from the end as the blind is moved from the fully retracted position toward the fully extended position, and move the lower rail toward the end as the blind nears the fully extended position.

17. The window shade of claim 16, further comprising a second cellular blind, a second carriage slidably mounted to the track and releasably connected to the second blind, a second cord positioned within the groove of the track, with a loop of the second cord extending from an opposite end of the track, and wherein pulling on one side of the loop of the second cord moves the second cord within the groove and moves the attached second carriage along the track, and movement of the second carriage along the track moves the second blind between collapsed and extended positions.

18. The window shade of claim 17, further comprising the hub engaging an inner end of the second blind and permitting movement of the second blind between the hub and the opposite end of the track, the hub biasing the second blind toward the opposite end of the track, the hub is configured to push a lower rail of the second blind outward toward the opposite end of the curved track when the second blind is in the fully retracted position, allow movement of the lower rail of the second blind away from the opposite end as the second blind is moved from the fully retracted position toward the fully extended position, and move the lower rail of the second blind toward the opposite end as the second blind nears the fully extended position.

19. The window shade of claim 16, further comprising a second cellular blind, a second carriage slidably mounted to the track and releasably connected to the second blind, the second carriage connected to the cord and wherein pulling on one side of the loop of the cord moves the cord within the groove and moves the attached carriages along the track, and movement of the carriages along the track moves the blinds between collapsed and extended positions.

20. The window shade of claim 19, further comprising the hub engaging an inner end of the second blind and permitting movement of the second blind between the hub and an opposite end of the track, the hub biasing the second blind toward the opposite end of the track, the hub is configured to push a lower rail of the second blind outward toward the opposite end of the curved track when the second blind is in the fully retracted position, allow movement of the lower rail of the second blind away from the opposite end as the second blind is moved from the fully retracted position toward the fully extended position, and move the lower rail of the second blind toward the opposite end as the second blind nears the fully extended position.

21. The window shade of claim 16, wherein the cord includes a plurality of spaced apart beads.

22. The window shade of claim 16, wherein the track includes opposing grooves and the cord travels from the end of the track within a first groove to a second end of the track, at the second end of the track the cord passes about an end fitting and enters a second groove and travels back to the end of the track, the cord extends from the first groove and from the second groove at the end of the track to form the loop.

23. The window shade of claim 22, further comprising a chain guide mounted at the end of the track and through which the loop of the cord passes, the chain guide directing the loop of the cord toward a desired location for actuation by a user.

* * * * *